US009956772B2

(12) United States Patent
Arakane et al.

(10) Patent No.: US 9,956,772 B2
(45) Date of Patent: May 1, 2018

(54) PRINTING APPARATUS

(71) Applicant: BROTHER KOGYO KABUSHIKI KAISHA, Nagoya, Aichi (JP)

(72) Inventors: Satoru Arakane, Aichi (JP); Kenji Kawamoto, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days. days.

(21) Appl. No.: 15/471,686

(22) Filed: Mar. 28, 2017

(65) Prior Publication Data

US 2017/0282549 A1 Oct. 5, 2017

(30) Foreign Application Priority Data

Mar. 31, 2016 (JP) ..... 2016-073385

(51) Int. Cl.
*B41J 2/045* (2006.01)
*B41J 13/00* (2006.01)
*B41J 2/21* (2006.01)

(52) U.S. Cl.
CPC ..... *B41J 2/04573* (2013.01); *B41J 2/04505* (2013.01); *B41J 13/0009* (2013.01); *B41J 2/04586* (2013.01); *B41J 2/2135* (2013.01)

(58) Field of Classification Search
CPC ..... B41J 2/04573; B41J 2/04505; B41J 13/0009; B41J 2/2135; B41J 2/04586
See application file for complete search history.

(56) References Cited

U.S. PATENT DOCUMENTS

2015/0029254 A1 1/2015 Arakane
2015/0035891 A1 2/2015 Yoshida et al.
2017/0282611 A1* 10/2017 Arakane ..... B41J 13/0009

FOREIGN PATENT DOCUMENTS

JP 2015024601 A 2/2015
JP 2015030149 A 2/2015

* cited by examiner

*Primary Examiner* — Yaovi M Ameh
(74) *Attorney, Agent, or Firm* — Scully, Scott, Murphy & Presser, PC

(57) ABSTRACT

A printing apparatus, including a conveyor, a liquid ejection head with nozzles, a carriage, a carriage movement mechanism, and a controller, is provided. The controller executes a printing operation including a parameter determining process and an ejection timing determining process. In the parameter determining process, a value to a correction parameter is determined. In the ejection timing determining process, ejection timing to eject liquid through the nozzles is determined based on the value to the correction parameter. In the ejection timing determining process, the controller determines the ejection timing by shifting the ejection timing to be at least one of later and earlier than a reference timing for a time length corresponding to the value to the correction parameter. In the parameter determining process, the controller provides a different value to the correction parameter for the scan-printing action in the second unit-printing process depending on the nozzle shift amount.

16 Claims, 11 Drawing Sheets

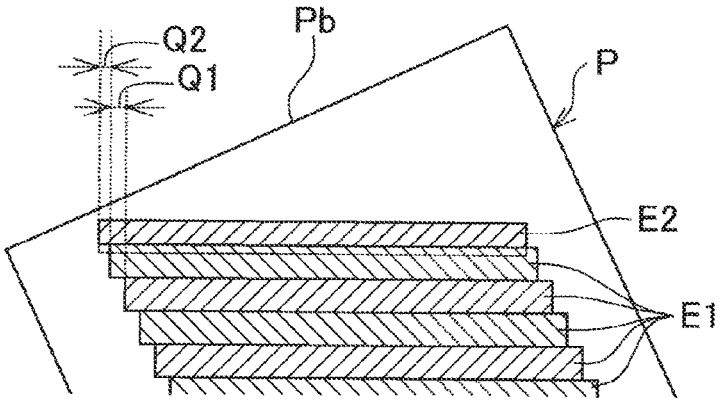
FIG. 11A
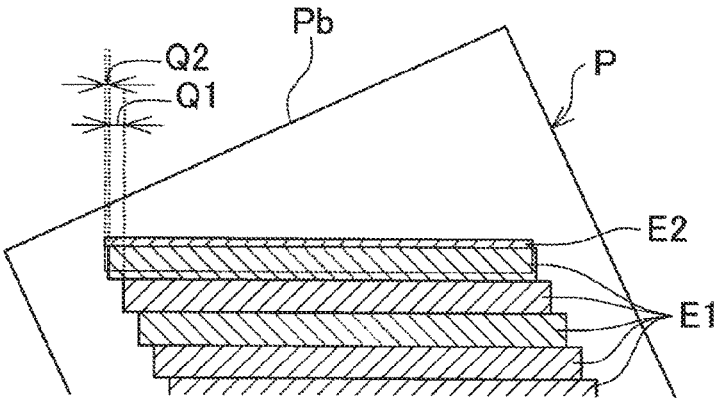
FIG. 11B
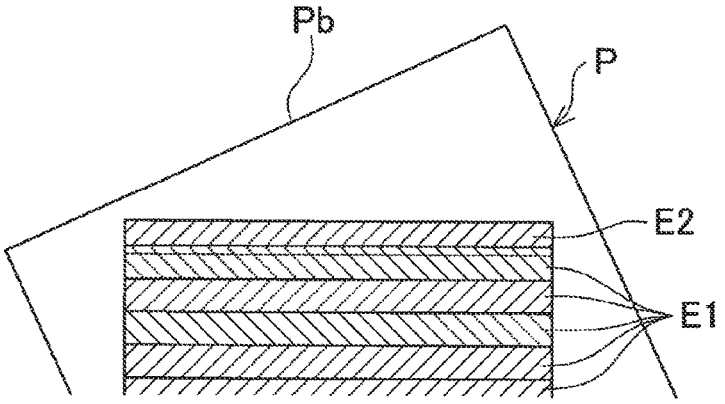
FIG. 11C
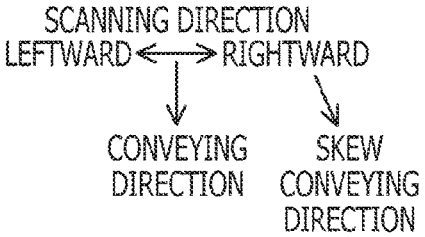

PRINTING APPARATUS

CROSS REFERENCE TO RELATED APPLICATION

This application claims priority under 35 U.S.C. § 119 from Japanese Patent Application No. 2016-073385, filed on Mar. 31, 2016, the entire subject matter of which is incorporated herein by reference.

BACKGROUND

Technical Field

The following description relates to one or more aspects of a printing apparatus capable of ejecting liquid through nozzles to print an image.

Related Art

A printing apparatus, or a printer, configured to eject liquid through nozzles at a recording sheet to print an image, is known. The printer may conduct a main scanning action, in which a print head is moved to reciprocate in a main scanning direction and driven to eject ink droplets through a plurality of nozzles at the recording sheet to print a row of image in dots on the recording sheet, and an auxiliary scanning action, in which the recording sheet is conveyed in a conveying direction that intersects orthogonally with the main scanning direction, alternately to print an image on the recording sheet. The rows of images printed continuously may form a complete image on the sheet.

The printer may have an upstream roller and a downstream roller to convey the recording sheet at positions upstream and downstream from the print head respectively along the conveying direction. As the recording sheet is conveyed in the printer, until a trailing end of the recording sheet passes through the upstream roller in each main scanning action, all of the nozzles may be used to eject the ink at the recording sheet; and in each auxiliary scanning action, the recording sheet may be conveyed for a predetermined amount in the conveying direction. On the other hand, once the trailing end of the sheet passes through the upstream roller, in each main scanning action, merely some of the nozzles, in particular, nozzles on an upstream side with regard to the conveying direction, may be activated to eject the ink at the sheet; and in each auxiliary scanning action, the sheet may be conveyed for a smaller amount than the predetermined amount. In this regard, among a series of the main scanning actions after the sheet passing through the upstream roller, a position of most downstream nozzles with regard to the conveying direction among the some of the active nozzles to eject the ink may shift depending on an order of the main scanning action within the series of the main scanning actions to print the image. In particular, the later the main scanning action is conducted, the further upstream a position of most downstream active nozzles with regard to the conveying direction among the some active ones of the nozzles may shift.

SUMMARY

In the above-mentioned printer, as the sheet is conveyed in the conveying direction along the print head, the sheet may swell by moisture of the ink applied thereto. Therefore, the sheet may expand, or contract, in the main scanning direction at a part downstream from the print head with regard to the conveying direction due to the swell. On the other hand, at an upstream part of the sheet from the print head, to which the ink is not yet applied, a dimension of the sheet in the main scanning direction may stay unchanged. In the meantime, the sheet may skew with respect to the conveying direction while being conveyed in the printer. When the sheet is conveyed in the skewed and expanded or contracted condition, rows of images continuously printed on the sheet in the main scanning action may be displaced at boundaries from each other along the scanning direction. Therefore, it may be preferable that timing to eject the ink from each nozzle of the print head in each main scanning action to print a row is adjusted to correct the displacement.

Meanwhile, as mentioned above, in the main scanning action after the trailing end of the sheet passing through the upstream roller, merely some of the nozzles may be used to eject the ink, and the amount to convey the sheet in the auxiliary scanning action may be reduced. Further, the nozzles to be used in the later main scanning action may be shifted. Therefore, if the discharging timing is adjusted without consideration of the shift of the nozzles to be used in the main scanning action, which is to be conducted after the trailing end of the sheet passing through the upstream roller, the displacement of rows of images along the main scanning direction at boundaries may not be corrected or moderated effectively.

An aspect of the present disclosure is advantageous in that a printing apparatus, in which displacement of images printed in scan-printing actions at boundaries there-between may be moderated, is provided.

According to an aspect of the present disclosure, a printing apparatus having a conveyor, a liquid ejection head, a carriage, a carriage movement mechanism, and a controller is provided. The conveyor is configured to convey a recording sheet in a conveying direction. The liquid ejection head includes a plurality of nozzles, which are arranged along the conveying direction to form a nozzle array. The liquid ejection head is mounted on the carriage. The carriage movement mechanism is configured to move the carriage in a carriage-movable direction. The carriage-movable direction includes a direction from one side toward the other side and a direction from the other side toward the one side along a direction that intersects with the conveying direction. The controller is configured to control the conveyor, the liquid ejection head, and the carriage movement mechanism. The controller executes a printing operation, in which a plurality of unit-printing processes are executed. Each one of the plurality of unit-printing processes includes a conveying action, in which the controller controls the conveyor to convey a recording sheet in the conveying direction, and a scan-printing action, in which after the conveying action the controller controls the carriage movement mechanism and the liquid ejection head to move the carriage in the carriage-movable direction and manipulate the plurality of nozzles to eject liquid at the recording sheet. The conveying action includes a first conveying action and a second conveying action. In the first conveying action, a first nozzle, among the plurality of nozzles that form the nozzle array, located at a position downstream from a most upstream one of the plurality of nozzles with regard to the conveying direction is designated to be a nozzle active at a most downstream position with regard to the conveying direction for the scan-printing action, and the controller controls the conveyor to convey the recording sheet for a first conveyance amount based on print data. In the second conveying action, a second nozzle, among the plurality of nozzles that form the nozzle array, located at a position upstream with regard to the conveying direction apart from the first nozzle for a length corresponding to a sum of hitherto conveyance amounts for the recording sheet conveyed in preceding conveying actions in the plurality of unit-printing processes in the printing operation is designated to be a nozzle active to print a most downstream part of an image that is to be printed in the scan-printing action, and the controller controls the conveyor to convey the recording sheet for a second conveyance amount, which is smaller than the first conveyance amount for a nozzle shift amount. The nozzle shift amount is equal to a length between the first nozzle and the second nozzle along the conveying direction. The controller executes one of a first unit-printing process and a second unit-printing process for each one of the plurality of unit-printing processes in the printing operation. The first unit-printing process takes the first conveying action as the conveying action, and the second unit-printing process takes the second conveying action as the conveying action. In the printing operation, the controller executes a parameter determining process and an ejection timing determining process. In the parameter determining process, a value to a correction parameter is determined. The correction parameter is a parameter to correct ejection timing to eject the liquid through the plurality of nozzles in the scan-printing action. In the ejection timing determining process, the ejection timing is determined based on the value to the correction parameter. In the ejection timing determining process, the controller determines the ejection timing based on a reference timing by shifting the ejection timing to be at least one of later and earlier than the reference timing for a time length corresponding to the value to the correction parameter. In the parameter determining process, the controller provides a different value to the correction parameter for the scan-printing action in the second unit-printing process depending on the nozzle shift amount.

BRIEF DESCRIPTION OF THE ACCOMPANYING DRAWINGS

Figure 7A:
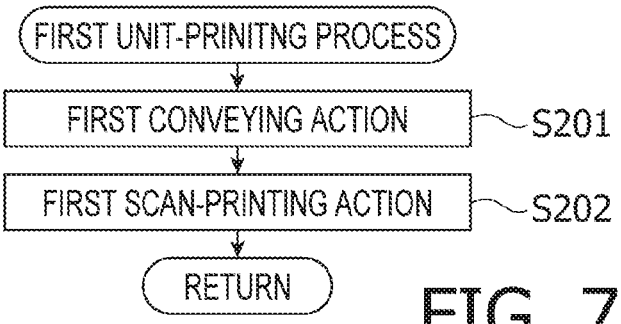
Figure 7B:
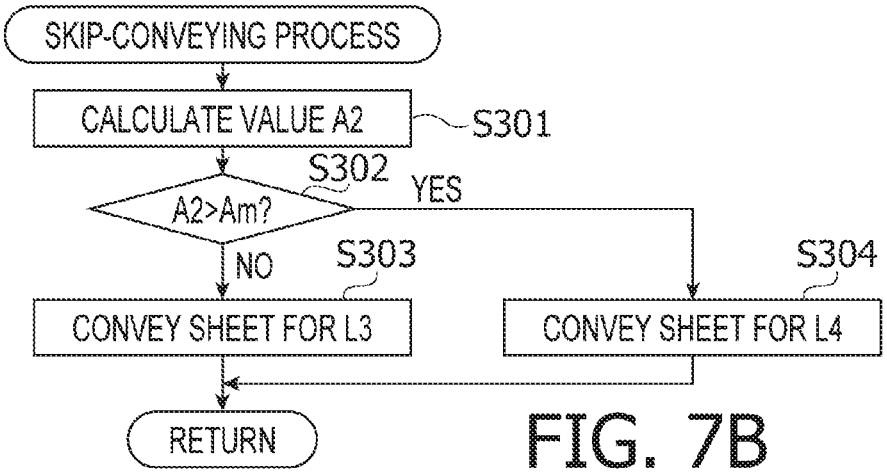
Figure 7C:
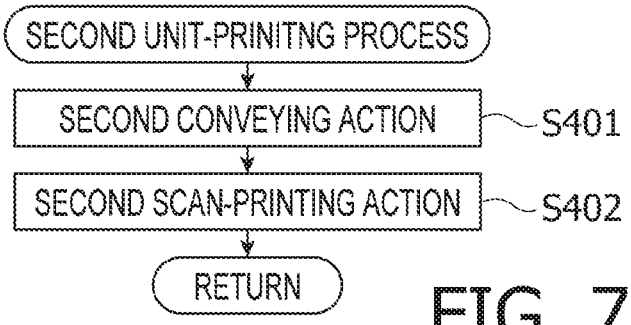

FIG. 7A is a flowchart to illustrate a flow of steps in a first unit-printing process to be conducted by the controller in the printer according to the embodiment of the present disclosure. FIG. 7B is a flowchart to illustrate a flow of steps in a skip-conveying action to be conducted by the controller in the printer according to the embodiment of the present disclosure. FIG. 7C is a flowchart to illustrate a flow of steps in a second unit-printing process to be conducted by the controller in the printer according to the embodiment of the present disclosure.

Figure 8A:
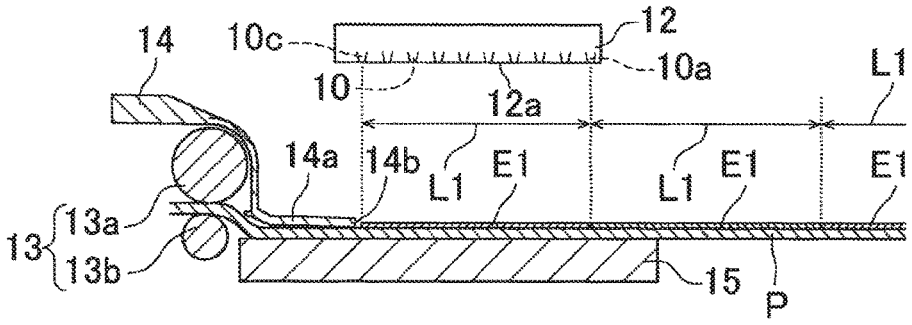
Figure 8B:
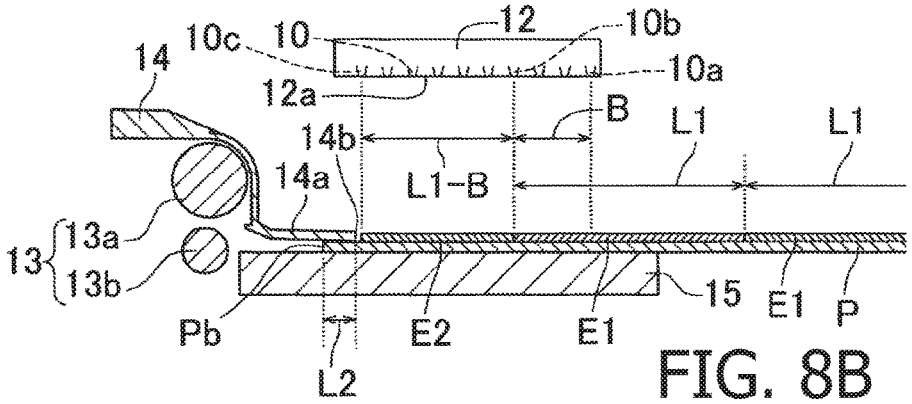
Figure 8C:
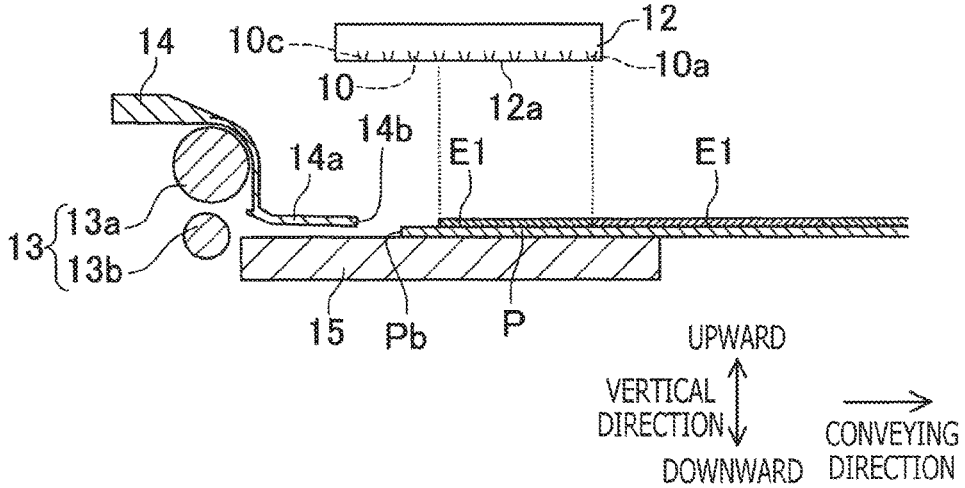

FIG. 8A illustrates relative positions of an inkjet head, corrugating plates, and a recording sheet in the printer during the first unit-printing process according to the embodiment of the present disclosure. FIG. 8B illustrates relative positions of the inkjet head, the corrugating plates, and the recording sheet in the printer during the second unit-printing process according to the embodiment of the present disclosure. FIG. 8C illustrates relative positions of the inkjet head, the corrugating plates, and the recording sheet in the printer when the recording sheet is at a position separated from pressers according to the embodiment of the present disclosure.

Figure 9:
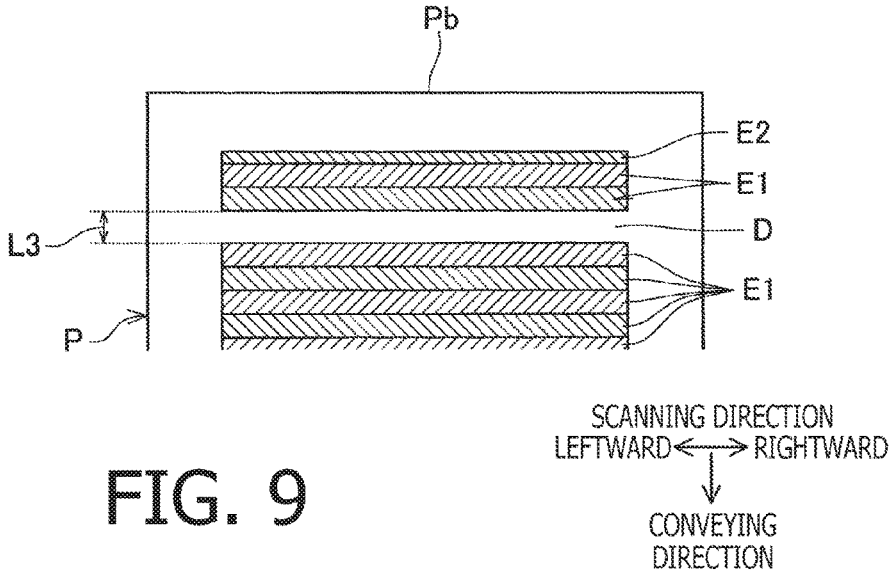

FIG. 9 is an illustrative view of a blank area on the recording sheet according to the embodiment of the present disclosure.

Figure 10A:
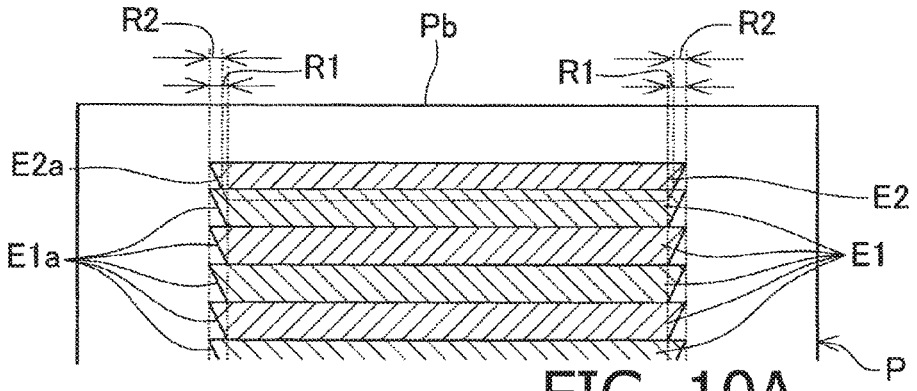
Figure 10B:
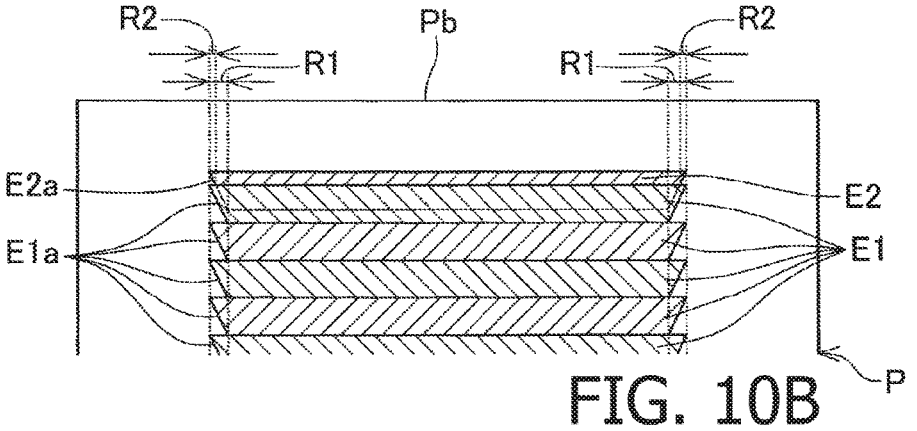
Figure 10C:
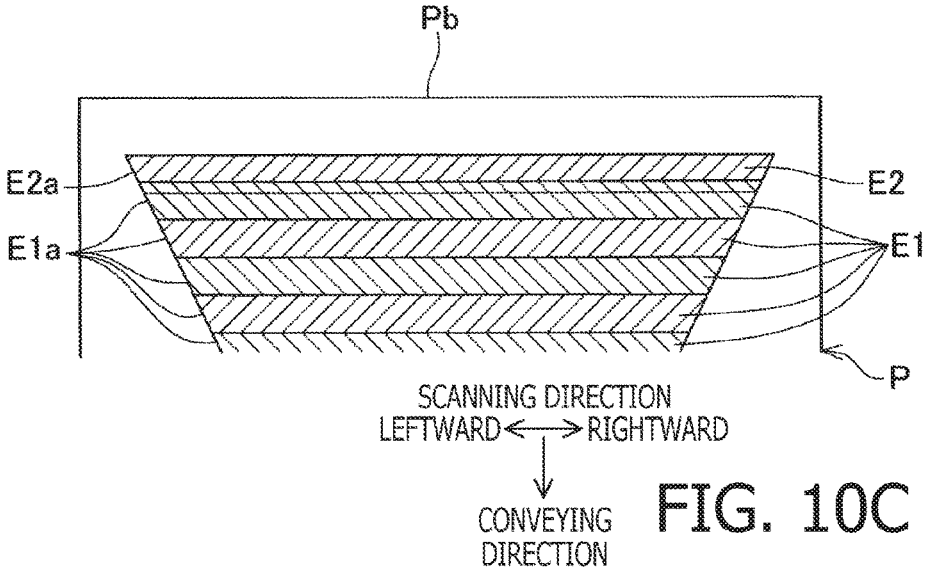

FIG. 10A illustrates rows of images printed on the recording sheet that contracts or expands in a scanning direction at a different extent depending on a position of the row on the recording sheet, printed with invariable correction parameters $\beta1_{(m)}$, $\beta2_{(m,B)}$ in the printing apparatus according to the embodiment of the present disclosure. FIG. 10B illustrates rows of images printed on the same recording sheet, printed with correction parameters $\beta1_{(m)}$, $\beta2_{(m,B)}$ determined in consideration of a larger nozzle shift amount in the printing apparatus according to the embodiment of the present disclosure. FIG. 10C illustrates rows of images printed on the same recording sheet, printed with correction parameters $\beta1_{(m)}$, $\beta2_{(m,B)}$ determined in consideration of the larger nozzle shift amount and the position of the row on the recording sheet in the printing apparatus according to the embodiment of the present disclosure.

FIG. 11A illustrates rows of images printed on the recording sheet that skews with respect to a conveying direction, printed with invariable correction parameters $\gamma_{(m)}$, $\gamma2_{(m,B)}$ in the printing apparatus according to the embodiment of the present disclosure. FIG. 11B illustrates rows of images printed on the same recording sheet, printed with correction parameters $\gamma1_{(m)}$, $\gamma2_{(m,B)}$ determined in consideration of a larger nozzle shift amount in the printing apparatus according to the embodiment of the present disclosure. FIG. 11C illustrates rows of images printed on the same recording sheet, printed with correction parameters $\gamma1_{(m)}$, $\gamma2_{(m,B)}$ determined in consideration of the larger nozzle shift amount and the position of the row on the recording sheet in the printing apparatus according to the embodiment of the present disclosure.

DETAILED DESCRIPTION

Hereinafter, an embodiment according to an aspect of the present disclosure will be described in detail with reference to the accompanying drawings.

It is noted that various connections may be set forth between elements in the following description. These connections in general and, unless specified otherwise, may be direct or indirect and that this specification is not intended to be limiting in this respect. Aspects of the disclosure may be implemented in computer software as programs storable on computer readable media including but not limited to a random access memory (RAM), a read-only memory (ROM), a flash memory, an electrically erasable ROM (EEPROM), a CD-media, DVD-media, temporary storage, hard disk drives, floppy drives, permanent storage, and the like.

[Overall Configuration of Printer]

A printer 1 of the embodiment may be a multi-function peripheral (MFP) having a plurality of functions such as a printing function to print an image on a recording sheet P and an image reading function to read an image on a sheet. The printer 1 includes a printing unit 2 (see FIG. 2), a sheet feeder unit 3, a sheet ejector unit 4, a reader unit 5, an operation unit 6, and a display unit 7. Further, the printer 1 includes a controller 50 configured to control operations and processes in the printer 1 (see FIG. 5).

The printing unit 2 is disposed inside the printer 1. The printing unit 2 is configured to perform printing with the recording sheet P. A detailed configuration of the printing unit 2 will be described later. The sheet feeder unit 3 is configured to feed the recording sheet P to the printing unit 2. The feeder unit 3 may contain different sizes of recording sheets P separately, and one of the different-sized recording sheets P may be selectively fed to the printing unit 2 during a printing operation. The sheet ejector unit 4 is configured to eject the recording sheet P, on which an image is printed by the printing unit 2, outside. The reader unit 5 may be an image scanner and may be configured to read images formed on original sheets. The operation unit 6 may include buttons. A user may operate the printer 1 via the buttons in the operation unit 6 to enter information or instructions. The display unit 7 may be a liquid crystal display, which may display information when the printer 1 is being used.

[Printing Unit]

Figure 2:
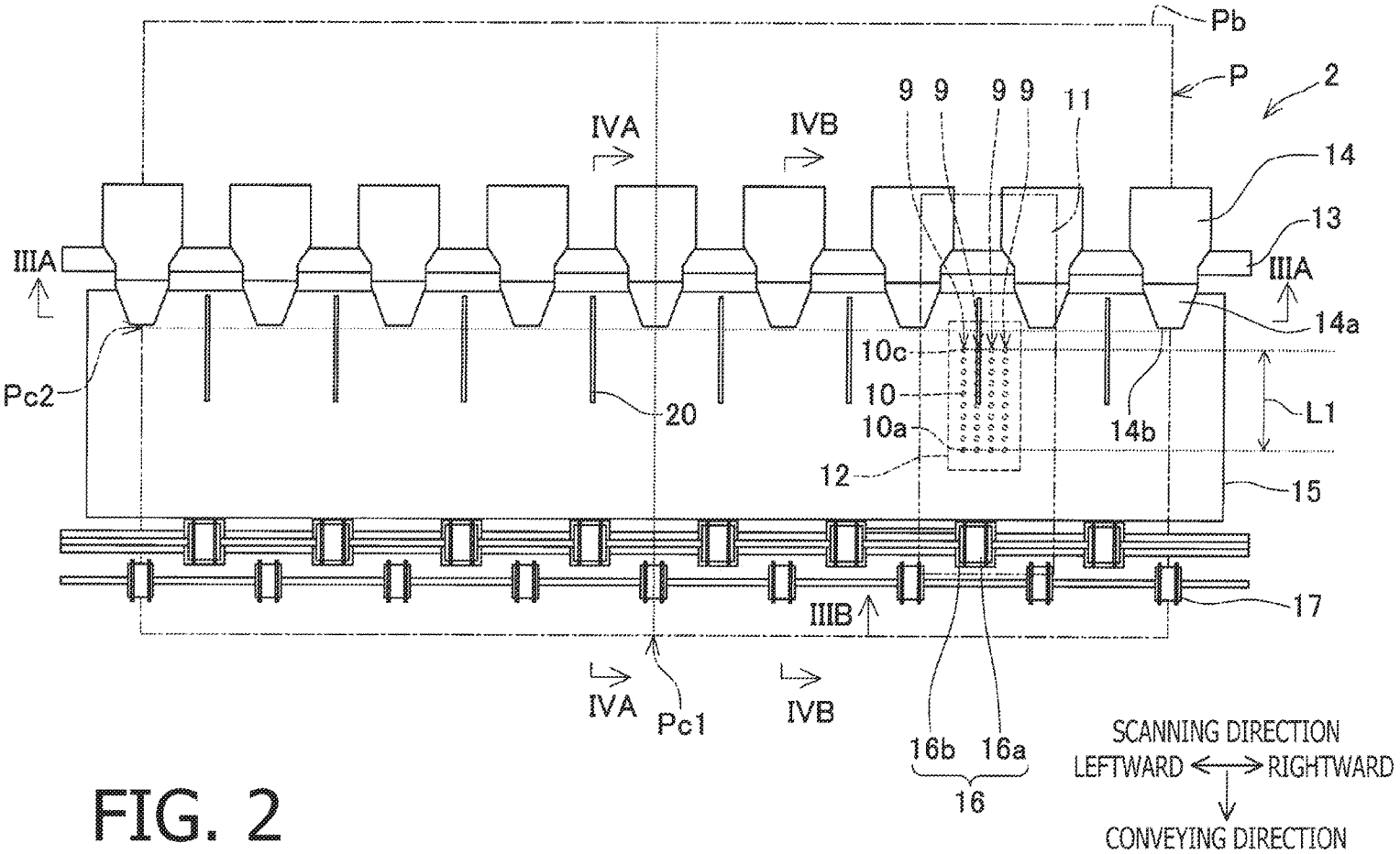
FIG. 2 is a plan view of a printing unit in the printer according to the embodiment of the present disclosure.
Figure 3A:
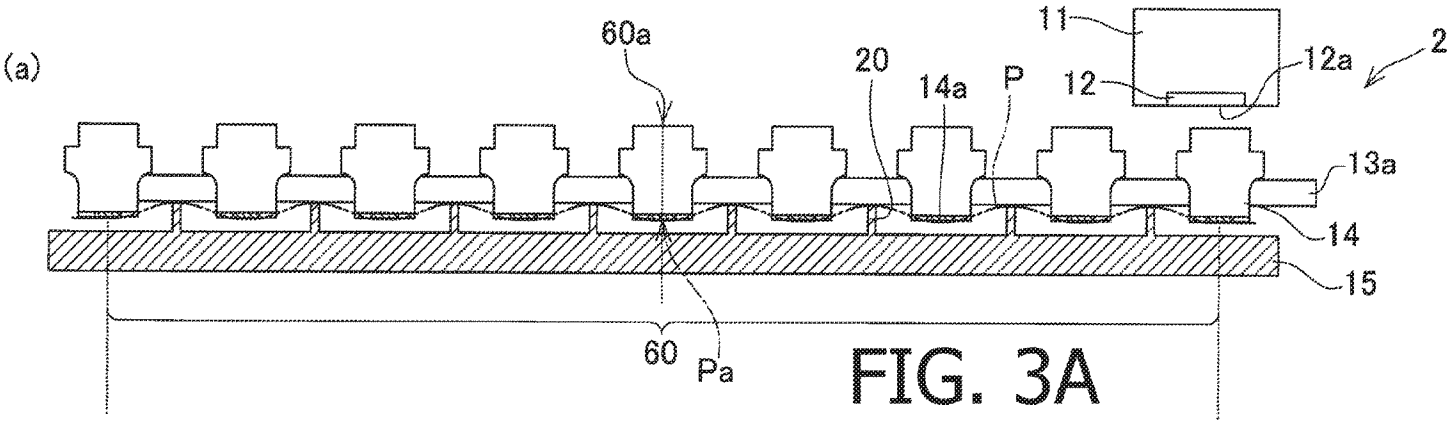
FIG. 3A illustrates a part of the printing unit viewed along an arrow IIIA shown in FIG. 2 according to the embodiment of the present disclosure.
Figure 3B:
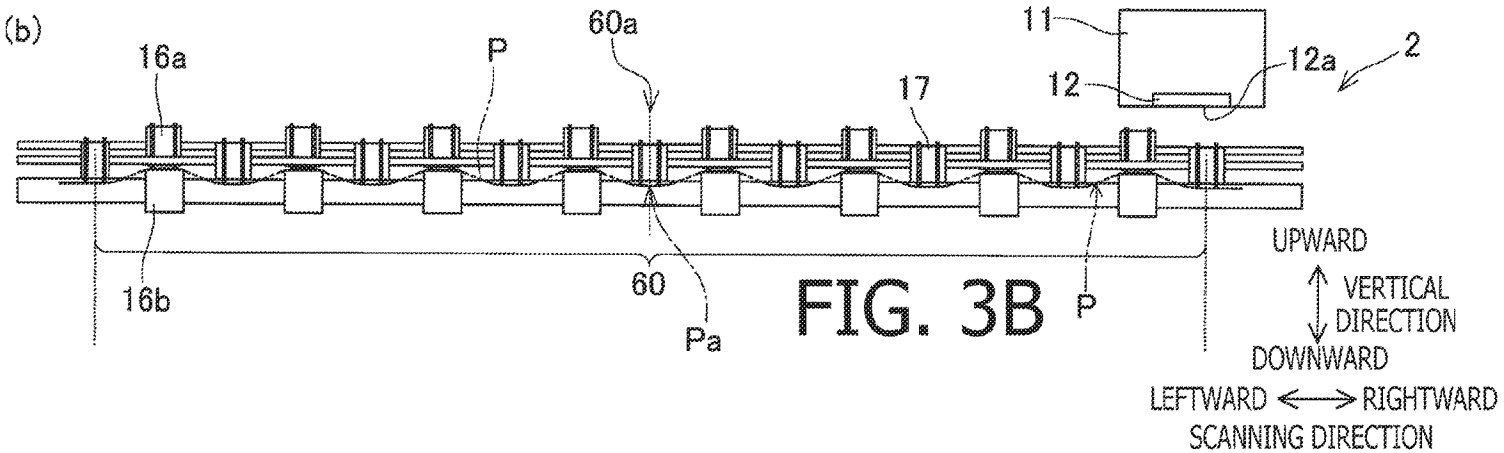
FIG. 3B illustrates a part of the printing unit viewed along an arrow IIIB shown in FIG. 2 according to the embodiment of the present disclosure.
Figure 4A:
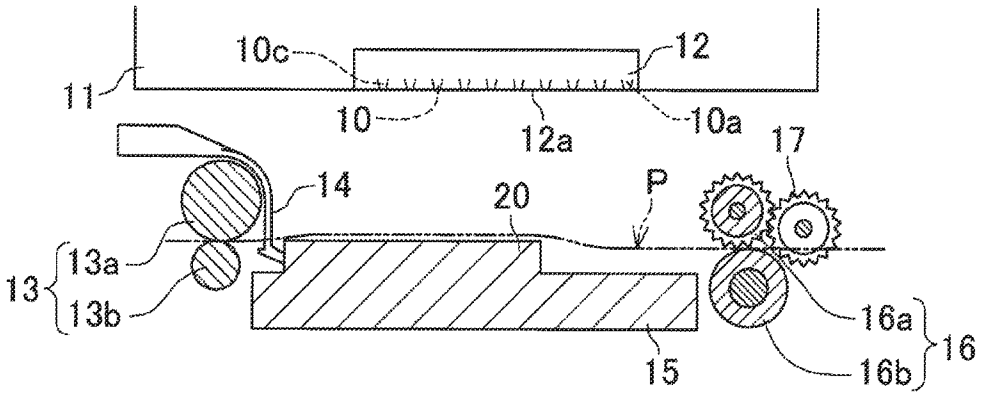
FIG. 4A is a cross-sectional view taken along a line IVA-IVA shown in FIG. 2 according to the embodiment of the present disclosure.
Figure 4B:
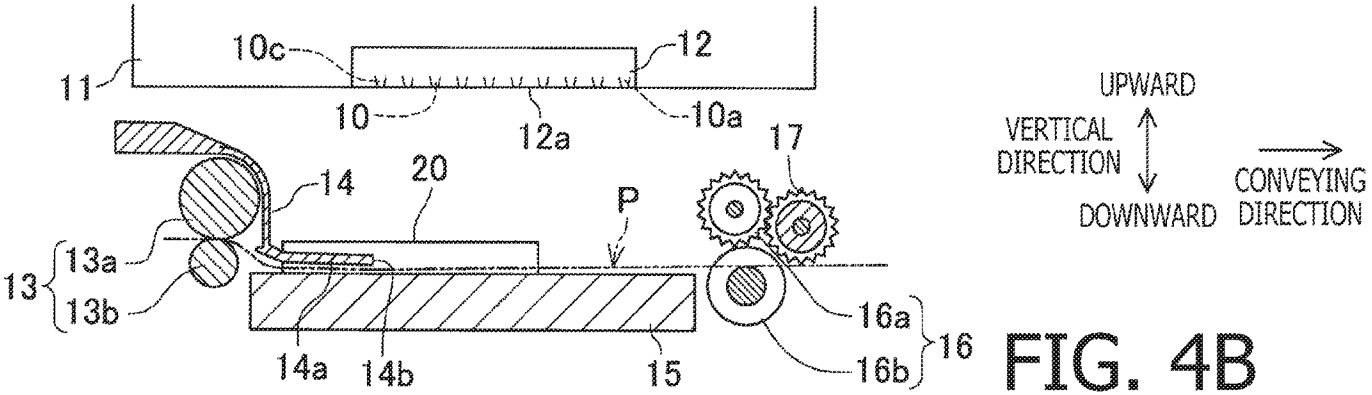
FIG. 4B is a cross-sectional view taken along a line IVB-IVB shown in FIG. 2 according to the embodiment of the present disclosure.

Below will be described the printing unit 2. As shown in FIGS. 2 to 4, the printing unit 2 includes a carriage 11, an inkjet head 12, a conveyance roller 13, a platen 15, a plurality of (e.g., nine) corrugating plates 14, a plurality of (e.g., eight) ejection rollers 16, and a plurality of (e.g., nine) corrugating spur wheels 17. It is noted that, for the purpose of easy visual understanding in FIG. 2, the carriage 11 in an illustrative position is indicated by a dash-and-two-dots line, and items disposed below the carriage 11 are indicated by solid lines. Further, in FIG. 2, illustration of some of structures that support the carriage 11, e.g., a guiderail, may be omitted.

Figure 1:
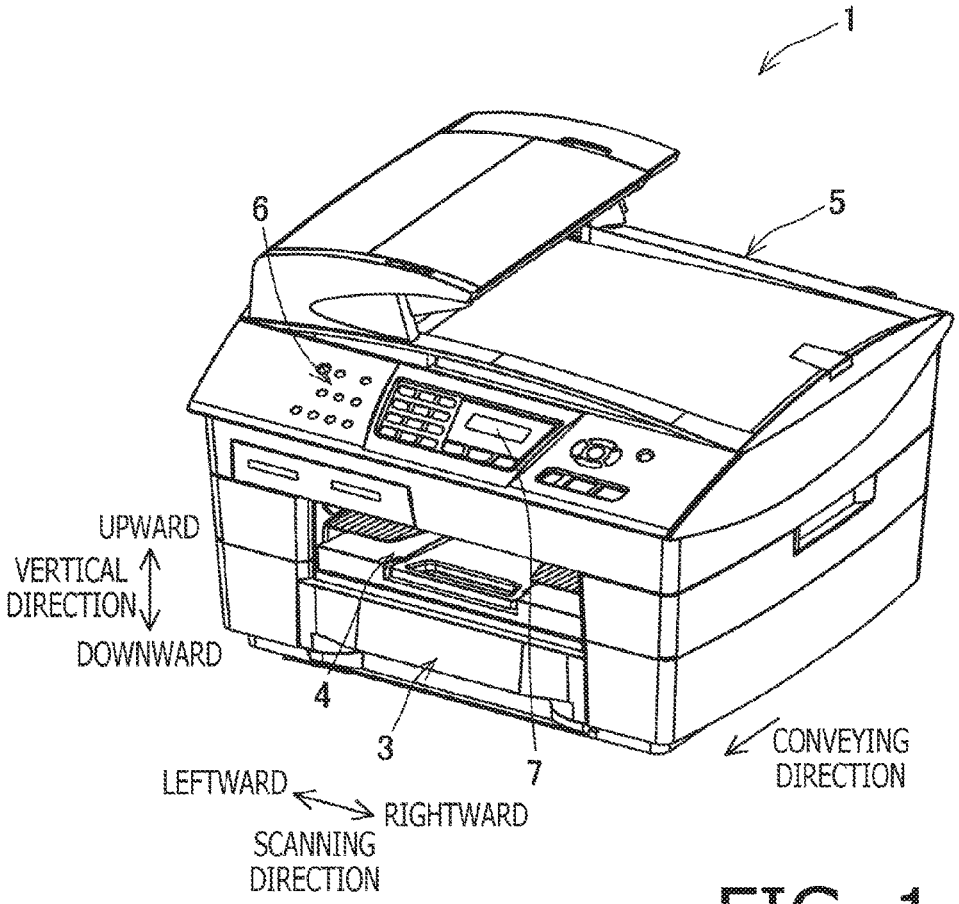
FIG. 1 is a perspective view schematically showing a configuration of a printer according to an exemplary embodiment of the present disclosure.

The carriage 11 is configured to reciprocate on the guiderail (not shown) along a scanning direction. In the present embodiment, the scanning direction may include a leftward (right-to-left) direction and a rightward (left-to-right) direction (see FIGS. 1 and 2, for example) and may be referred to as a widthwise direction. The carriage 11 is connected with a carriage motor 56 (see FIG. 5) through a belt (not shown) to be moved to reciprocate in the scanning direction. In other words, the carriage motor 56 and the belt that connects the carriage motor 56 with the carriage 11 may move the carriage 11. In the following description, one end on the left and the other end on the right along the scanning direction will be defined as a leftward end and a rightward end, respectively.

The inkjet head 12 is mounted on the carriage 11 to be movable along with the carriage 11. The inkjet head 12 is configured to eject ink from a plurality of nozzles 10 formed in an ink ejection surface 12*a*, which is a lower surface of the inkjet head 12. The nozzles 10 are formed in lines that extend orthogonally to the scanning direction within a length L1 to form nozzle arrays 9. In the inkjet head 12, a plurality of, e.g., four, nozzle arrays 9 are formed so that inks in four colors, e.g., black, yellow, cyan, and magenta, may be ejected separately from each nozzle array 9. For example, the nozzles 10 in the rightmost nozzle array 9 may eject black ink, and the nozzles 10 in the nozzle arrays 9 from the second, third, and fourth to the right may eject other colored (e.g., yellow, cyan, and magenta) inks, respectively. The inkjet head 12 may be driven by a driver IC 40 (see FIG. 5).

The conveyance roller 13 is arranged in a position upstream of the inkjet head 12 with regard to a predetermined conveying direction, which may intersect orthogonally with the scanning direction, to convey the recording sheet P. The conveyance roller 13 includes an upper roller 13*a* and a lower roller 13*b*, which are configured to nip therebetween the recording sheet P fed by the sheet feeder unit 3 and convey the recording sheet P in the conveying direction. The upper roller 13*a* may be driven to rotate by a conveyor motor 57 (see FIG. 5), and the lower roller 13*b* may be rotated along with rotation of the upper roller 13*a*.

The nine (9) corrugating plates 14 are disposed to extend from a position coincident with the conveyance roller 13 to a position downstream of the conveyance roller 13 with regard to the conveying direction. The corrugating plates 14 are arranged to be spaced apart evenly from one another at an interval along the scanning direction. Each of the corrugating plates 14 includes a presser 14*a*, which may contact to press the recording sheet P downward, at a downstream end 14*b* thereof with regard to the conveying direction. The downstream end 14*b* of each presser 14*a* is located at a position downstream from an upstream end of the inkjet head 12 and upstream from a position of nozzles 10*c* that are located most upstream among the plurality of nozzles 10 in the nozzle arrays 9.

The platen 15 is arranged in a position downstream of the conveyance roller 13 with regard to the conveying direction to vertically face the ink ejection surface 12*a* of the inkjet head 12. The platen 15 is arranged to longitudinally extend in the scanning direction to cover an entire movable range of the carriage 11 that may move to reciprocate during a printing operation. On an upper surface of the platen 15, formed are a plurality of (e.g., eight) ribs 20, which extend in the conveying direction. The ribs 20 are arranged to be spaced apart evenly from one another at the interval along the scanning direction in positions between adjoining corrugating plates 14 to support the recording sheet P from below.

Upper ends of the ribs 20 are at a position higher than the pressers 14*a*. In other words, the ribs 20 support the recording sheet P from below at positions higher than positions where the pressers 14*a* contact or press the recording sheet P.

The ejection rollers 16 are arranged in positions downstream of the inkjet head 12 with regard to the conveying direction. The ejection rollers 16 are located in the same positions as the ribs 16 with regard to the scanning direction. Each ejection roller 16 includes an upper roller 16*a* and a lower roller 16*b*, between which the recording sheet P may be nipped from above and below to be conveyed in the conveying direction. The ejection rollers 16 thus convey the recording sheet P in the conveying direction toward the sheet ejector unit 4. The lower rollers 16*b* may be driven to rotate by the conveyor motor 57 (see FIG. 5). The upper rollers 16*a* are spur wheels and may be rotated by the rotation of the lower rollers 16*b*. The upper rollers 16*a* may contact a printed surface of the recording sheet P, which is a surface having an image printed thereon in the ongoing printing operation. However, while the upper rollers 16*a* are spurs, of which outer circumferences are not smooth, the ink in the printed image on the recording sheet P may be restrained from being transferred to the upper rollers 16*a*. Thus, the conveyance roller 13 and the ejection rollers 16 may convey the recording sheet P.

The corrugating spur wheels 17 are arranged in positions downstream from the ejection rollers 16 with regard to the conveying direction and may contact to press the recording sheet P from above. The corrugating spur wheels 17 are substantially at the same positions as the pressers 14*a* of corrugating plates 14 with regard to the scanning direction. The corrugating spur wheels 17 are not rollers with smooth outer circumferences but spur wheels. Therefore, the ink on the recording sheet P may be restrained from being transferred to the corrugating spur wheels 17.

It may be noted that the above-mentioned quantities of the corrugating plates 14, the ribs 20, the ejection rollers 16, and the corrugating spur wheels 17 are merely examples, and the numbers may not necessarily be limited to these.

The recording sheet P may be supported by the eight (8) ribs 20 and the eight (8) lower rollers 16*b* on a lower surface from below and by the nine (9) pressers 14*a* of the corrugating plates 14 and the nine (9) corrugating spur wheels 17 on the upper surface from above to be shaped into the corrugated form, as shown in FIGS. 3 and 4, which ripples up and down along the scanning direction.

[Controller]

Next, explanation concerning the controller 50 for controlling operations and processes in the printer 1 will be provided below. The controller 50 includes a central processing unit (CPU) 51, a ROM 52, a RAM 53, an EEPROM 54, and an application specific integrated circuit (ASIC) 55. The controller 50 controls behaviors of the carriage motor 56, the driver IC 40, the inkjet head 12, the conveyor motor 57, the reader unit 5, and the display unit 7. Further, the controller 50 may receive various types of signals, including signals corresponding to operations to the operation unit 6.

Figure 5:
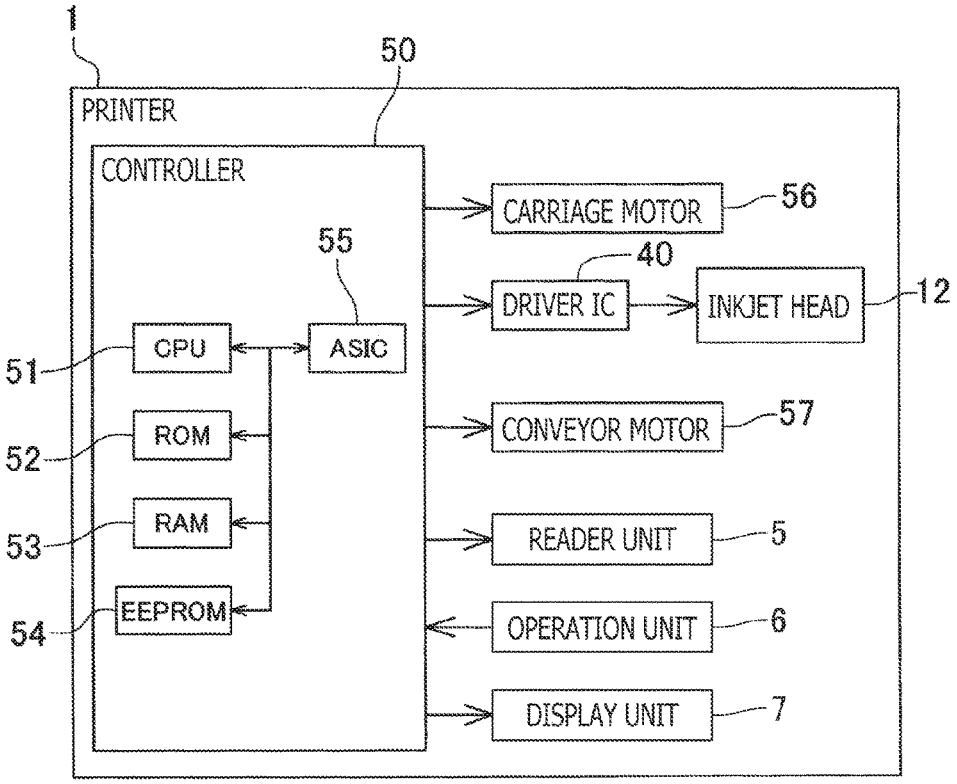
FIG. 5 is a block diagram to illustrate an electrical configuration of the printer according to the embodiment of the present disclosure.

While FIG. 5 shows solely one (1) CPU 51 to process the signals in the controller 50, the CPU 51 may not necessarily be limited to a single CPU 51 that processes the signals alone but may include a plurality of CPUs 51 that may share the loads of the signal-processing. Further, the ASIC 55 in the controller 50 may not necessarily be limited to a single ASIC that processes the signals alone but may include multiple ASICs 55 that may share the loads of the signal-processing.

[Printing Operation]

Next, actions in a printing operation to print an image on the recording sheet P will be described. In the printing operation, the controller 50 may control the printing unit 2 to print an image, containing rows of images, on the recording sheet P according to the flow of steps shown in FIG. 6.

When print data is input to the printer 1, the controller 50 conducts a printing operation, in which a unit-printing process may be repeated for a plurality of times, to print an image corresponding to the print data. In each unit-printing process, a conveying action, in which the controller 50 controls the conveyor motor 57 to manipulate the conveyance roller 13 and the ejection rollers 16 to convey the recording sheet P in the conveying direction, and a scan-printing action, in which the controller 50 controls the carriage motor 56 to move the carriage 11 in the scanning direction and controls the driver IC 40 to manipulate the inkjet head 12 to eject the ink through the nozzles 10, are conducted.

Figure 6:
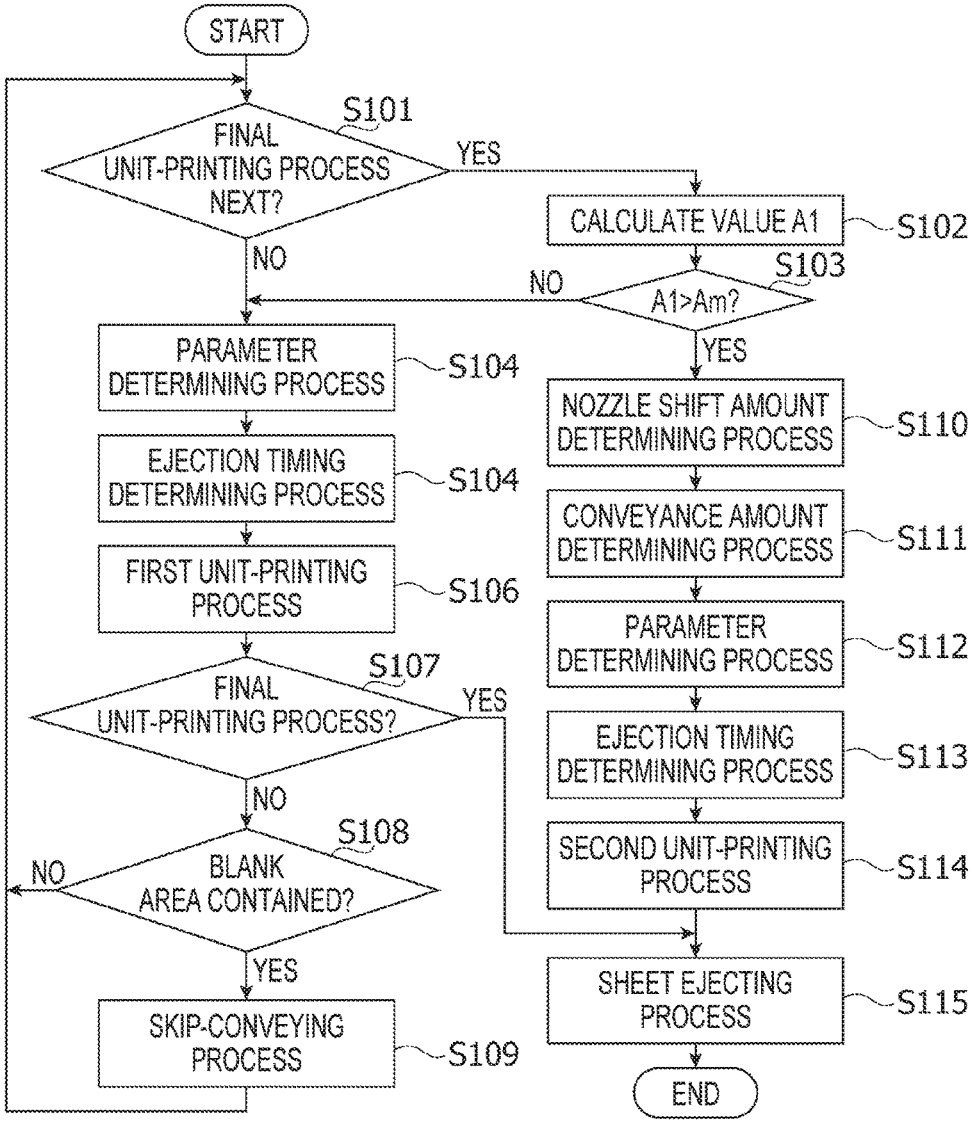
FIG. 6 is a flowchart to illustrate a flow of steps in a printing operation to be conducted by a controller in the printer according to the embodiment of the present disclosure.

Below will be described more specifically the printing operation. As shown in FIG. 6, in S101, the controller 50 determines based on the print data whether a next upcoming unit-printing process is a final unit-printing process in the ongoing printing operation.

When the next unit-printing process is a final unit-printing process (S101: YES), in S102, the controller 50 calculates a value A1, which indicates a predicted position of the recording sheet P after hypothetical conveyance of the recording sheet P from a current position for the length L1 of the nozzle arrays 9 in the conveying direction. The value A1 to indicate the position of the recording sheet P is plotted to be larger if the recording sheet P is located further downstream and to be smaller if the recording sheet P is located further upstream with regard to the conveying direction. In other words, the closer the recording sheet P is to a downstream end of the sheet conveyance, the larger value the value A1 should take. The value A1 may be calculated, for example, based on a retrospective sum of hitherto conveyance amounts for the recording sheet P in the ongoing printing operation and a size of the recording sheet P.

In S103, the controller 50 determines whether the calculated value A1 is larger than a threshold value Am, which is prepared and stored in advance in the EEPROM 54. The threshold value Am may be, for example, a value that corresponds to a position of the recording sheet P when an upstream end Pb (see FIG. 8B) of the recording sheet P with regard to the conveying direction is located at an upstream position spaced apart from the downstream end 14*b* of the presser 14*a* for a predetermined length L2.

Therefore, when the upstream end Pb of the recording sheet P is at the upstream position spaced apart from the downstream end 14*b* of the presser 14*a* for the predetermined length L2 or a larger length, i.e., at the position shown in FIG. 8B, the value A1 is smaller than or equal to the threshold value Am. In this position, the recording sheet P contacts the pressers 14*a* and may be pressed downward by the pressers 14*a*. On the other hand, when the upstream end Pb of the recording sheet P is at a position downstream from the upstream position spaced apart from the downstream end 14*b* of the presser 14, as shown in FIG. 8C, the value A1 is greater than the threshold value Am. In this position, the recording sheet P is separated from the pressers 14*a* along the conveying direction and may not be contacted or pressed by the pressers 14*a*. In other words, in S103, the controller 50 may predict whether the recording sheet P is to be conveyed to the position where the recording sheet P is separated from the pressers 14 in the conveying direction as a result of being conveyed for the length L1.

When the next unit-printing process is not a final unit-printing process in the ongoing printing operation (S101: NO); or when the next printing process is a final unit-printing process (S101: YES), and the calculated value A1 is smaller than or equal to the threshold value Am (S103: NO); the controller 50 conducts a parameter determining process in S104 and an ejection timing determining process in S105. In S104, values to correction parameters $\alpha$, $\beta 1_{(m)}$, $\gamma 1_{(m)}$, and $\sigma$ to be used in a first scan-printing action, which will be described later in detail, are determined. In S105, ejection timing, which will be described later in detail, to eject the ink through the nozzles 10 in the first scan-printing action is determined.

In S106, the controller 50 conducts a first unit-printing process. Specifically, as shown in FIG. 7A, in S201, the controller 50 conducts a first conveying action. In the first conveying action, the controller 50 controls the conveyor motor 57 to manipulate the conveyance roller 13 and the ejection rollers 16 to convey the recording sheet P in the conveying direction for the length L1, which is equal to the length of the nozzle arrays 9 along the conveying direction, as shown in FIG. 8A. When the recording sheet P is conveyed in the first conveying action, a center Pc1 of the recording sheet P in the scanning direction is located to align with a center 60*a* of a movable range 60 for the inkjet head 12 to move during the scan-printing action. In the present embodiment, if no skip-conveying action, which will be described later, is conducted following a latest first unit-printing process, the conveying action to convey the recording sheet P in S201 may be regarded as the first conveying action in the present disclosure; meanwhile, if a skip-conveying action is conducted following the latest first unit-printing process, the conveying action to convey the recording sheet P in S201 and a conveying action to convey the recording sheet P in the skip-conveying action in S109, which will be described later, combined together may be regarded as the first conveying action in the present disclosure.

Following S201, in S202, the controller 50 conducts a first scan-printing action. Specifically, the controller 50 controls the carriage motor 56 to move the carriage 11 rightward or leftward along the scanning direction. Simultaneously, the controller 50 controls the driver IC 40 to manipulate the inkjet head 12 to eject the ink through the nozzles 10 at the ejection timing determined in 5105 to print a row of image E1. In the first scan-printing action, as shown in FIG. 8A, nozzles 10*a* at a most downstream position with regard to the conveying direction among the entire nozzles 10 that form the nozzle arrays 9 are designated as the nozzles 10 active at a most downstream position for the first scan-printing action. With this nozzle designation, a length of the row of image E1 to be printed in the first scan-printing action along the conveying direction may be maximized to the largest for the inkjet head 12, and a number of scan-printing actions necessary to complete the printing operation may be minimized.

Following the first unit-printing process in S105, in S107, if the latest first unit-printing process in S105 is the final unit-printing process (S107: YES), in S115, the controller 50 conducts a sheet ejecting process and ends the flow thereat. In the sheet ejecting process in S115, the controller 57 controls the conveyor motor 57 to manipulate the ejection roller 16 to convey the recording sheet P at the ejection unit 4 to eject the recording sheet P.

In S107, if the latest first unit-printing process is not the final unit-printing process (S107: NO), in S108, the controller 50 inspects the print data and determines whether the image to be printed in the ongoing printing operation should contain a blank area D (see FIG. 9), in which no row of image is to be printed, having a predetermined minimum length Lm or larger along the conveying direction, at an upstream adjacent position from the image E1 printed in the latest first scan-printing action in S202. The length Lm may be, for example, from 4 to 5% of the length L1 of the nozzle arrays 9. If no blank area D is contained (S108: NO), the flow returns to S101. On the other hand, if the image contains the blank area D (S108: YES), in S109, the controller 50 conducts a skip-conveying action and thereafter returns to S101.

In the skip-conveying action in S109, specifically as shown in FIG. 7B, in S301, the controller 50 calculates a value A2, which indicates a predicted position of the recording sheet P after the recording sheet P is conveyed from the current position for a length L3 in the conveying direction. The length L3 is equal to a length of the blank area D along the conveying direction. Following S301, in S302, the controller 50 determines whether the calculated value A2 is larger than the threshold value Am.

If the calculated value A2 is smaller than or equal to the threshold value Am (S302: NO), in S303, the controller 50 controls the conveyor motor 57 to manipulate the conveyance roller 13 and the ejection rollers 16 to convey the recording sheet P in the conveying direction for the length L3. On the other hand, if the calculated value A2 is larger than the threshold value Am (S302: YES), in S304, the controller 50 controls the conveyor motor 57 to manipulate the conveyance roller 13 and the ejection rollers 16 to convey the recording sheet P in the conveying direction for a length L4 (not shown), which is shorter than the length L3 of the blank area D. The length L4 is a length within a range, in which the recording sheet P may be maintained contacted to be pressed by the pressers 14*a*, even after being conveyed for that length. When the recording sheet P is conveyed in S303 or S304, the center Pc1 of the recording sheet P in the scanning direction is located to align with the center 60*a* of the movable range 60 for the inkjet head 12.

Thus, when the blank area D exits in the print data and in the image to be printed, the skip-conveying action is conducted to convey the recording sheet P so that time required to print the complete image may be shortened. In order to convey the recording sheet P, when the calculated value A2 is smaller than or equal to the threshold value Am (S302: NO), the recording sheet P is conveyed for the length L3, which is the length of the blank area D. On the other hand, when the calculated value A2 is larger than the threshold value Am (S302: YES), the recording sheet P is conveyed for the length L4, which is shorter than the length L3 of the blank area D. Thus, the recording sheet P may be prevented from being conveyed as far as to a position, where the recording sheet P is separated from the pressers 14*a* along the conveying direction and is not contacted or pressed by the pressers 14*a*.

Meanwhile, referring back to FIG. 6, if the next unit-printing process is the final unit-printing process for the image on the recording sheet P (S101: YES), and the value A1 calculated in S102 is larger than the threshold value Am (S103: YES), the controller 50 conducts a nozzle shift-amount determining process in S110. In the nozzle shift-amount determining process, a difference [A1−Am] between the calculated value A1 and the threshold value Am is determined to be a nozzle shift amount B. Following S110, in S111, the controller 50 conducts a conveyance amount determining process to determine an amount to convey the recording sheet P in a second conveying action, which will be described later. In the conveyance amount determining process, a conveyance amount [L1−B], which is a difference between the length L1 of the nozzle arrays 9 and the nozzle shift amount B, is determined to be the amount to convey the recording sheet P in the second conveying action.

In the present embodiment, the nozzle shift amount B is determined earlier in S110, and the amount to convey the recording sheet P for the second conveying action is determined later in S111 based on the nozzle shift amount B. However, the order to determine the nozzle shift amount B and the conveyance amount may alternatively be reversed. In other words, the amount to convey the recording sheet P in the second conveying action, i.e., an amount corresponding to the conveyance amount [L1−B], may be determined earlier, and the nozzle shift amount B may be determined based on the conveyance amount later.

Following the determination of the conveyance amount, in S112, the controller 50 conducts a parameter determining process to determine correction parameters $\alpha$, $\beta 2_{(m,B)}$, $\gamma 2_{(m,}$ $_{B)}$, and σ to be used in a second scan-printing action, which will be described later. Following S112, in S113, the controller 50 conducts an ejection timing determining process, in which timing to eject the ink through the nozzles 10 in the second scan-printing action is determined. The correction parameters α, $\beta 2_{(m,B)}$, $\beta 2_{(m,B)}$, and σ and the ejection timing for the second scan-printing action will be described later in detail.

Following S113, in S114, the controller 50 conducts a second unit-printing process. In the second unit-printing process, as shown in FIG. 7C, in S401, the controller 50 conducts a second conveying action. Specifically, the controller 50 controls the conveyor motor 57 to manipulate the conveyance roller 13 and the ejection rollers 16 to convey the recording sheet P in the conveying direction for the conveyance amount [L1−B], as shown in FIG. 8B. When the recording sheet P is conveyed in S401, the center Pc1 of the recording sheet P with regard to the scanning direction is located to align with the center 60*a* of the movable range 60 for the inkjet head 12. In the present embodiment, if no skip-conveying action, which will be described later, is conducted following a latest first unit-printing process, the conveying action to convey the recording sheet P in S401 may be regarded as the second conveying action in the present disclosure; meanwhile, if a skip-conveying action is conducted following the latest first unit-printing process, the conveying action to convey the recording sheet P in S401 and a conveying action to convey the recording sheet P in the skip-conveying action, which will be described later, combined together may be regarded as the second conveying action in the present disclosure.

Following S401, in S402, the controller 50 conducts a second scan-printing action. In the second scan-printing action, the controller 50 controls the carriage motor 56 to move the carriage 11 rightward or leftward along the scanning direction. Simultaneously, the controller 50 controls the driver IC 40 to manipulate the inkjet head 12 to eject the ink through the nozzles 10 at the ejection timing determined in S109 to print a row of image E2. In the second scan-printing action, as shown in FIG. 8B, nozzles 10*b* at a position shifted upstream from the nozzles 10*a* for the nozzle shift amount B among the entire nozzles 10 that form the nozzle arrays 9 are designated as the nozzles 10 active at the most downstream position for the second scan-printing action.

In this regard, attention may be drawn to a hypothetical flow of steps, in which the first unit-printing process is conducted even when the next unit-printing process is the final unit-printing process in the ongoing printing operation (S101: YES), and the calculated value A1 is larger than the threshold value Am (S103: YES), unlike the present embodiment. According to this hypothetical flow, as shown in FIG. 8C, the recording sheet P conveyed in the first conveying action may be located at a position downstream from the position corresponding to the threshold value Am, in which the recording sheet P is separated from the pressers 14*a* and not contacted or pressed by the pressers 14*a*. In this position, without being contacted or pressed downward by the pressers 14*a*, the upstream end Pb of the recording sheet P with regard to the conveying direction released from the pressers 14*a* may hover upward and collide with the ink ejection surface 12*a* in the succeeding first scan-printing action. If the recording sheet P collides with the ink ejection surface 12*a*, the ink on the ink ejection surface 12*a* may be undesirably transferred to the recording sheet P.

In consideration of such an undesirable event, according to the present embodiment, when the next unit-printing process is a final unit-printing process in the ongoing printing operation (S101: YES), and when the value A1 is larger than the threshold value Am (S103: YES), the controller 50 conducts the second unit-printing process. Therefore, as shown in FIG. 8B, the recording sheet P conveyed in the second conveying action may be maintained contacted to be pressed by the pressers 14*a* at the upstream end Pb with regard to the conveying direction. Thus, the recording sheet P may be prevented from colliding with the ink ejection surface 12*a* in the succeeding second scan-printing action.

Following the second unit-printing process in S114, in S115, the controller 50 conducts the sheet ejecting process and ends the flow thereat.

[Correction Parameters and Ejection Timing for the First Scan-Printing Action]

Below will be described the correction parameters α, $\beta 1_{(m)}$, $\gamma 1_{(m)}$, and σ and the ejection timing for the first scan-printing action.

Values to the correction parameters α, $\beta 1_{(m)}$, $\gamma 1_{(m)}$, and σ are determined in the parameter determining process in S104 (see FIG. 6). The values to the correction parameters α, $\beta 1_{(m)}$, $\gamma 1_{(m)}$, and σ may be prepared and stored in advance in the EEPROM 54, and in S104, these values may be taken as the correction parameters α, $\beta 1_{(m)}$, $\gamma 1_{(m)}$, and σ. The sign m in the correction parameters $\beta 1_{(m)}$, $\gamma 1_{(m)}$ indicates that the correction parameters are for the m-th scan-printing action to print the m-th row of image among the plurality of scan-printing actions in the printing operation.

Further, in the ejection timing determining process, in S105, the timing to eject the ink through the nozzles 10 in the first scan-printing action is determined. Specifically, timing shifted from a predetermined reference timing for a length of correction time F1(X), which is derived from a following Formula [1], is designated to be the ejection timing.

$$F1(x)=\alpha\times G(x)+\beta 1_{(m)}\times x+\gamma 1_{(m)}+\sigma \quad \text{[Formula 1]}$$

The term reference timing refers to timing assumed to eject the ink at a hypothetical recording sheet P, which is not shaped into the corrugated form but is flat, and no ink is applied thereto yet, so that the ejected ink should land on the recording sheet P at predetermined equal intervals along the scanning direction. The value x represents a position on the recording sheet P in the scanning direction: a value x for the center 60*a* is zero (0); a position on an upstream side from the center 60*a* with regard to a moving direction (e.g., rightward or leftward) of the carriage 11 in m-th row along the scanning direction is represented by a positive value; and a position on a downstream side from the center 60*a* with regard to the moving direction of the carriage 11 in the m-th row is represented by a negative value. When the correction time F1(x) indicates a positive value, the ejection timing to eject the ink through the nozzles 10 at the recording sheet P is delayed for a length F1(x) from the reference timing. When the correction time F1(x) indicates a negative value, the ejection timing to eject the ink through the nozzles 10 at the recording sheet P is advanced for a length F1(x) from the reference timing.

When the recording sheet P is in the corrugated shape rippling up and down along the scanning direction, height of the recording sheet P, i.e., a gap between the recording sheet P and the ink ejection surface 12*a*, at each position along the scanning direction may vary. Therefore, the term α×G(x) is provided in the correction time F1(x) to correct the ejection timing to eject the ink through the nozzles 10 in consideration of the variation in the gap between the ink ejection surface 12*a* and the recording sheet P along the scanning direction that is caused by the corrugated form of the recording sheet P. The function G(x) is a function provided to comply with the variation in the gap between the ink ejection surface 12*a* and the recording sheet P along the scanning direction that is caused by shaping the recording sheet P into the corrugated form. The function G(x) may be prepared and stored in advance in the EEPROM 54. The correction parameter $\alpha$ is a parameter provided to the function G(x) and may depend on a factor such as type or characteristics of the recording sheet P.

The term $\beta 1_{(m)} \times x$ is provided in the correction time F1(x) to correct the ejection timing to eject the ink in the first scan-printing action in view of the positions in the recording sheet P moved in the scanning direction by the contraction or expansion caused by the recording sheet P shaped into the corrugated form. As the height of each position in the recording sheet P that is shaped into the corrugated form changes, the recording sheet P may contract or expand, or move, in the scanning direction. In other words, each position on the recording sheet P with regard to the scanning direction may change. Further, by the swelling effect of the moisture in the ink applied to the recording sheet P, the recording sheet P may tend to stretch in the scanning direction, and each position of the recording sheet P in the scanning direction may further change. In this regard, while each point in the recording sheet P may move in the scanning direction by the influence of the link landed on the recording sheet P in the corrugated form, points in an outer area with regard to the scanning direction may further move in the scanning direction by an inner part of the recording sheet P, which is closer to the center 60*a*, moving toward the center 60*a* due to the influence of the ink landed on the inner areas. Therefore, an amount for a point in the recording sheet P to move in the scanning direction may be larger or smaller depending on closeness or farness of the point in the scanning direction to or from the center 60*a*. In other words, the farther the point is located from the center 60*a* along the scanning direction, for the larger amount the point may move, at an increasing rate being proportional to the value in x.

When the entire recording sheet P is contracted in the scanning direction due to the factors described above, the correction parameter $\beta 1_{(m)}$ takes a positive value. Therefore, the term $\beta 1_{(m)} \times x$ in the correction time F1(x) should indicate a positive value, as long as the point is on the upstream side from the center 60*a* with regard to the moving direction of the carriage 11 (x>0), so that the ejection timing is delayed to be later than the reference timing, and should indicate a negative value, as long as the point is on the downstream side from the center 60*a* with regard to the moving direction of the carriage 11 (X<0), so that the ejection timing is advance to be earlier than the reference timing.

On the other hand, when the entire recording sheet P is expanded in the scanning direction, the correction parameter $\beta 1_{(m)}$ takes a negative value. Therefore, the term $\beta 1_{(m)} \times x$ in the correction time F1(x) should indicate a negative value, as long as the point is on the upstream side from the center 60*a* with regard to the moving direction of the carriage 11 (x>0), so that the ejection timing is advanced to be earlier than the reference timing, and should indicate a positive value, as long as the point is on the downstream side from the center 60*a* with regard to the moving direction of the carriage 11 (X<0), so that the ejection timing is delayed to be later than the reference timing.

Thus, the ejection timing is shifted from the reference timing for a longer period of time as the correction parameter $\beta 1_{(m)}$ indicates a larger value and for a shorter period of time as the correction parameter $\beta 1_{(m)}$ indicates a smaller value. Therefore, in the first scan-printing action in S202 (see FIG. 7A), when the value given to the correction parameter $\beta 1_{(m)}$ takes a positive value, as long as the point to eject the ink through the nozzles 10 is on the upstream side of the center 60*a* with regard to the moving direction of the carriage 11, the ejection timing to eject the ink at the point is delayed to be later than the reference timing as the point is farther from the center 60*a*. Meanwhile, as long as the point to eject the ink through the nozzles 10 is on the downstream side of the center 60*a* with regard to the moving direction of the carriage 11, the ejection timing to eject the ink at the point is advanced to be earlier than the reference timing as the point is farther from the center 60*a*. Accordingly, the landing positions of the ink should be displaced inward toward the center 60*a* in the scanning direction.

On the other hand, when the value given to the correction parameter $\beta 1_{(m)}$ takes a negative value, as long as the point to eject the ink through the nozzles 10 is on the upstream side of the center 60*a* with regard to the moving direction of the carriage 11, the ejection timing to eject the ink at the point is advanced to be earlier than the reference timing as the point is farther from the center 60*a*. Meanwhile, as long as the point to eject the ink through the nozzles 10 is on the downstream side of the center 60*a* with regard to the moving direction of the carriage 11, the ejection timing to eject the ink at the point is delayed to be later than the reference timing as the point is farther from the center 60*a*. Accordingly, the landing positions of the ink should be displaced outward from the center 60*a* in the scanning direction.

Further, according to the present embodiment, intensity of the force to press the recording sheet P by the pressers 14*a* and the ribs 20 that are on the upstream side of the ink ejection surface 12*a* with regard to the conveying direction and intensity of the force to press the recording sheet P by the ejection rollers 16 and the corrugating spur wheels 17 that are on the downstream side of the ink ejection surface 12*a* with regard to the conveying direction may differ. Moreover, while a part of the recording sheet P that is on the downstream side of the ink ejection surface 12*a* with regard to the conveying direction may swell by the moisture of the ink, another part of the recording sheet P that is on the upstream side of the ink ejection surface 12*a* with regard to the conveying direction, to which the ink is not yet applied, may be dry without swelling. Therefore, extent of the contraction or the expansion of the recording sheet P in the scanning direction, i.e., a length of the recording sheet P in the corrugated form along the scanning direction, may vary depending on the position of the row in the conveying direction. Accordingly, as shown in FIGS. 10A-10C, an end E1*a* of each row of image E1 along the scanning direction tends to incline with respect to the scanning direction. FIGS. 10A-10C may illustrate the inclination of the ends E1*a* of the images E1, when the upstream part of the recording sheet P with regard to the conveying direction contracts more largely than the downstream part. Meanwhile, the downstream part of the recording sheet P with regard to the conveying direction may contract more largely than the upstream part. In such a case, the ends E1*a* of the images E1 may incline in a reversed direction.

While the ends E1*a* of the images E1 tends to incline with respect to the conveying direction, if the same correction parameter $\beta 1_{(m)}$ is invariably applied to calculate the ejection timing regardless of a position of the row of image E1 or order of the first scan-printing action among the series of the first scan-printing actions in the printing operation, as shown in FIGS. 10A-10B, the rows of images E1 may not be connected correctly at borders there-between. In other words, displacement may appear to be visible at the borders between the images E1. In view of this potential defect, in the present embodiment, the correction parameter $\beta 1_{(m)}$ takes different values depending on the position of the row or the order of the first scan-printing action within the series of first scan-printing actions in the printing operation.

Specifically, when the recording sheet P is contracted or expanded more largely in the upstream part than the downstream part with regard to the conveying direction, for an earlier first scan-printing action among the series of first scan-printing actions, the correction parameter $\beta 1_{(m)}$ takes a value, of which absolute value $|\beta 1_{(m)}|$ is smaller; and for a later first scan-printing action, the correction parameter $\beta 1_{(m)}$ takes a value, of which absolute value $|\beta 1_{(m)}|$ is larger. In other words, the later the first scan-printing action is conducted within the printing operation, the larger the absolute value $|\beta 1_{(m)}|$ of the correction parameter $\beta 1_{(m)}$ is increased. The correction parameters $\beta 1_{(m)}$ for the first, the second, and continuous first scan-printing actions may be expressed in inequalities: $\beta_{(1)}<\beta_{(2)}< \ldots$.

On the other hand, when the recording sheet P is contracted or expanded more largely in the downstream part than the upstream part with regard to the conveying direction, for an earlier first scan-printing action among the series of first scan-printing actions, the correction parameter $\beta 1_{(m)}$ takes a value, of which absolute value $|\beta 1_{(m)}|$ is larger; and for a later first scan-printing action, the correction parameter $\beta 1_{(m)}$ takes a value, of which absolute value $|\beta 1_{(m)}|$ is smaller. In other words, the later the first scan-printing action is conducted, the smaller the absolute value $|\beta 1_{(m)}|$ of the correction parameter $\beta 1_{(m)}$ is reduced. The correction parameters $\beta 1_{(m)}$ for the first, the second, and continuous first scan-printing actions may be expressed in inequalities: $\beta_{(1)}>\beta_{(2)}> \ldots$.

With the values to the correction parameter $\beta 1_{(m)}$ for the first scan-printing actions determined as above, as shown in FIG. 10C, displacement between the rows of images E1, which may be caused by the contraction or expansion of the recording sheet P in the scanning direction, may be moderated or reduced.

The term $\gamma 1_{(m)} \times x$ in the correction time F1(x) is provided to correct the ejection timing in consideration of skew of the recording sheet P with respect to the conveying direction while the recording sheet P is conveyed in the first scan-printing action. If no correction to the ejection timing in view of the skew is made, for example, as shown in FIG. 11A-11B, the rows of images E1 may be entirely displaced in the scanning direction, and the displacement of the images E1 may appear to be visible at the borders there-between. It may be noted that FIGS. 11A-11B illustrate the recording sheet P inclining rightward with respect to the conveying direction, e.g., a skew conveying direction indicated by an arrow in FIGS. 11A-11C.

Therefore, for example, as shown in FIGS. 11A-11B, the later the row of image E1 is printed on the upstream side in a first scan-printing action, the further leftward the row of image E1 may be displaced in the scanning direction. In consideration of the displacement, when the row of image E1 is printed in a first scan-printing action at a position downstream from a center Pc2 (see FIG. 2) of the recording sheet P with regard to the conveying direction, as long as the carriage 11 is moving leftward, the correction parameter $\gamma 1_{(m)}$ takes a positive value so that the ejection timing is delayed to be later than the reference timing; and as long as the carriage 11 is moving rightward, the correction parameter $\gamma 1_{(m)}$ takes a negative value so that the ejection timing is advanced to be earlier than the reference timing. Thereby, the ink may land on the recording sheet P at a leftward position displaced in the scanning direction from a position, on which the ink ejected at timing without being corrected by the correction parameter $\gamma 1_{(m)}$ may land. The above-mentioned first scan-printing action to print the row of image E1 at the position downstream from the center Pc2 of the recording sheet P with regard to the conveying direction may be expressed as, for example, when the row of image E1 printed at the center Pc2 is printed in an Mth scan-printing action, an [M−1]th or earlier first scan-printing action.

On the other hand, when the image E1 is printed in a first scan-printing action at a position upstream from the center Pc2 of the recording sheet P with regard to the conveying direction, as long as the carriage 11 is moving leftward, the correction parameter $\gamma 1_{(m)}$ takes a negative value so that the ejection timing is advanced to be earlier than the reference timing; and as long as the carriage 11 is moving rightward, the correction parameter $\gamma 1_{(m)}$ takes a positive value so that the ejection timing is delayed to be later than the reference timing. Thereby, the ink may land on the recording sheet P at a rightward position displaced in the scanning direction from a position, on which the ink ejected at timing without being corrected by the correction parameter $\gamma 1_{(m)}$ may land. The above-mentioned first scan-printing action to print the row of image E1 at the position upstream from the center Pc2 of the recording sheet P with regard to the conveying direction may be expressed as, for example, when the row of image E1 printed at the center Pc2 is printed in the Mth scan-printing action, an [M+1]th or later first scan-printing action.

Meanwhile, the recording sheet P may incline leftward with respect to the conveying direction, in an opposite direction from the skew conveying direction shown in FIGS. 11A-11C. When the recording sheet P inclines rightward, positivity and negativity of the values in the correction parameter $\gamma 1_{(m)}$ described above based on the rightward inclination are reversed.

Furthermore, for a first scan-printing action among the series of first scan-printing actions farther from the center Pc2 in the conveying direction, the correction parameter $\gamma 1_{(m)}$ takes a value, of which absolute value $|\gamma 1_{(m)}|$ is larger; and for a first scan-printing action closer to the center Pc2 in the conveying direction, the correction parameter $\gamma 1_{(m)}$ takes a value, of which absolute value $|\gamma 1_{(m)}|$ is smaller. In other words, the farther from the center Pc2 the position of the first scan-printing action is, the larger the absolute value $|\gamma 1_{(m)}|$ of the correction parameter $\gamma 1_{(m)}$ is increased. In this regard, a magnitude relation of the absolute values in the correction parameters $\gamma 1_{(m)}$ is represented in inequalities: $|\gamma 1_{(1)}|> |\gamma 1_{(2)}|> \ldots |\gamma 1_{m-1)}|$, and $|\gamma 1_{(m-1)}|<|\gamma 1_{(m+2)}| \ldots$.

Furthermore, for the first scan-printing actions with the recording sheet P being inclined with respect to the conveying direction at a larger angle, the correction parameter $\gamma 1_{(m)}$ takes a value, of which absolute value $|\gamma 1_{(m)}|$ is larger. In other word, the larger the inclination of the recording sheet with respect to the conveying direction is, the larger the absolute value $|\gamma 1_{(m)}|$ in the correction parameter $\gamma 1_{(m)}$ is increased.

With the correction parameter $\gamma 1_{(m)}$ provided with the values as described above, in the first scan-printing action in S202 (see FIG. 7A), when the correction parameter $\gamma 1_{(m)}$ indicates a positive value, the ejection timing is delayed for the length indicated in the absolute value, regardless of the position in the scanning direction. On the other hand, when the correction parameter $\gamma 1_{(m)}$ indicates a negative value, the ejection timing is advanced for the length indicated in the absolute value, regardless of the position of the scanning direction. In other words, the ejection timing is shifted from the reference timing for a longer period of time as the correction parameter $\gamma 1_{(m)}$ indicates a larger value and for a shorter period of time as the correction parameter $\gamma 1_{(m)}$ indicates a smaller value. Thereby, as shown in FIG. 11C, displacement in the scanning direction at the border between the rows of images E1 printed in the first scan-printing actions, which may be caused by the inclination of the recording sheet P with respect to the conveying direction, may be moderated or reduced.

The correction parameter σ is provided to correct the landing positions for the ink on the recording sheet P in view of potential displacement of landing positions of the ink on the recording sheet P, which may be caused by a factor other than the change in the amplitude in the corrugated form of the recording sheet P, the contractive/expansive movement of the recording sheet P in the scanning direction, or the inclination of the recording sheet P with respect to the conveying direction. For example, the correction parameter a may be provided in view of an overall height and/or a position of the recording sheet P in the scanning direction, which may vary depending on a position of the recording sheet P in the conveying direction. In the meantime, however, the correction parameter σ may not necessarily be related to the present embodiment directly. Therefore, detailed explanation of the correction parameter a will be herein omitted.

The function G(x) and the values to the correction parameters α, $\beta 1_{(m)}$, $\gamma 1_{(m)}$, and σ may be obtained by, for example, a manufacturer manipulating the printer unit 2 to print a predetermined pattern of image on the recording sheet P and manipulating the reader unit 5 to read the image of the printed predetermined pattern from the recording sheet P, prior to shipping.

[Correction Parameters and Ejection Timing for the Second Scan-printing Action]

Below will be described the correction parameters and the ejection timing for the second scan-printing action.

As mentioned above, in the parameter determining process in S112 (see FIG. 6), the correction parameters α, $\beta 2_{(m)}$, $\gamma 2_{(m)}$, and σ to be used in each second scan-printing action are determined. Following S112, in the ejection timing determining process S113, the timing to eject the ink through the nozzles 10 in the second scan-printing action is determined. Specifically, timing shifted from the predetermined reference timing for a length of correction time F2(X), which is derived from a following Formula [2], is determined to be the ejection timing for the second scan-printing action.

$$F2(x)=\alpha\times G(x)+\beta 2_{(m,B)}\times x+\gamma 2_{(m,B)}+\sigma \quad \text{[Formula 2]}$$

Formula 2 may be similar to Formula 1 except that the correction parameters $\beta 1_{(m)}$, $\gamma 1_{(m)}$ in Formula 1 are replaced with the correction parameters $\beta 2_{(m,B)}$ and $\gamma 2_{(m,B)}$, respectively. The term $\beta 2_{(m,B)}\times x$ is provided in the correction time F2(X) to correct the ejection timing to eject the ink in the second scan-printing action in view of the positions in the recording sheet P moved in the scanning direction by the contraction or expansion caused by the recording sheet P shaped into the corrugated form. The term $\gamma 2_{(m)}\times x$ in the correction time F2(x) is provided to correct the ejection timing in consideration of the skew of the recording sheet P with respect to the conveying direction while the recording sheet P is conveyed in the second scan-printing action.

In S111, analogously to S104, the values to the correction parameters α and σ stored in the EEPROM 54 are taken as the correction parameters α and σ for the second scan-printing action.

Meanwhile, in S112, the value to the correction parameter $\beta 1_{(m)}$ stored in the EEPROM 54 is modified in consideration of the nozzle shift amount B, and the modified value is taken as the value to the correction parameter $\beta 2_{(m,B)}$. Specifically, the larger the nozzle shift amount B is, the smaller an absolute value $|\beta 1_{(m)}|$ in the correction parameter $\beta 1_{(m)}$ is modified to be, and the modified value is determined to be the value to the correction parameter $\beta 2_{(m,B)}$. In other words, the value to the correction parameter $\beta 2_{(m,B)}$ is reduced to be smaller as the nozzle shift amount B increases to be larger.

Further, in S112, the value to the correction parameter $\gamma 1_{(m)}$ stored in the EEPROM 54 is modified in accordance with the nozzle shift amount B, and the modified value is taken as the value to the correction parameter $\gamma 2_{(m,B)}$. Specifically, the larger the nozzle shift amount B is, the smaller an absolute value $|\gamma 1_{(m)}|$ in the correction parameter $\gamma 1_{(m)}$ is modified to be, and the modified value is determined to be the value to the correction parameter $\gamma 2_{(m,B)}$. In other words, the value to the correction parameter $\gamma 2_{(m,B)}$ is reduced to be smaller as the nozzle shift amount B increases to be larger.

Meanwhile, as mentioned above, the ends E1*a*, E2*a* of the rows of images E1, E2 tend to incline with respect to the conveying direction due to the contraction or expansion of the recording sheet P in the scanning direction. Therefore, if the correction parameters $\beta 1_{(m)}$, $\beta 1_{(m,B)}$, are invariably applied to calculate the ejection timing regardless of a position or order of the second scan-printing action among the series of the second scan-printing actions in the printing operation, as shown in FIGS. 10A-10B, the rows of images E1 and image E2 may not be connected correctly at borders there-between. In other words, displacement may appear to be visible at the borders between the rows of images E1 and between the row of image E1 and the row of image E2.

Further, while the recording sheet P is conveyed for an amount equal to the length L1 of the nozzle arrays 9 in the first conveying action, in the second conveying action, the recording sheet P is conveyed for a conveyance amount [L1−B], which is smaller than the length L1 of the nozzle arrays 9 for the nozzle shift amount B. Therefore, an amount R2 of the displacement at the border between the row of image E1 and the row of image E2 along the scanning direction may be reduced to be smaller than an amount R1 of the displacement at the border between the rows of images E1. In this regard, as seen in comparison between FIG. 10A and FIG. 10B, the larger the nozzle shift amount B is, in other words, the smaller value the conveyance amount [L1−B] for the second conveying action takes, the smaller value the amount R2 of the displacement takes.

Therefore, unlike the present embodiment, if the value to the correction parameter $\beta 1_{(m)}$ stored in the EEPROM 54 is taken as the value for the correction parameter $\beta 2_{(m,B)}$ without modifying, the displacement at the border between the row of image E1 and the row of image E2 may not be moderated or reduced.

In view of this potential defect, in the present embodiment, the value modified from the correction parameter $\beta 1_{(m)}$ in accordance with the nozzle shift amount B is taken as the correction parameter $\beta 2_{(m,B)}$. With the modified value to the correction parameter $\beta 2_{(m,B)}$ for the second scan-printing actions, as shown in FIG. 10C, the displacement at the border between the row of image E1 and the row of image E2, which may be caused by the contraction or expansion of the recording sheet P in the scanning direction, may be moderated or reduced.

Meanwhile, if no correction to the ejection timing in view of the skew of the recording sheet P is made, as shown in FIGS. 11A-11B, displacement with regard to the scanning direction may appear to be visible at the border between the rows of images E1 and the border between the row of image E1 and the row of image E2. An amount Q2 of the displacement between the row of image E1 and the row of image E2 in the scanning direction may be smaller than an amount Q1 of the displacement between the rows of images E1. In this regard, as seen in comparison between FIG. 11A and FIG. 11B, the larger the nozzle shift amount B is, in other words, the smaller value the conveyance amount [L1−B] for the second conveying action takes, the smaller value the amount Q2 of the displacement takes.

Therefore, unlike the present embodiment, if the value to the correction parameter $\gamma 1_{(m)}$ stored in the EEPROM 54 is taken as the value for the correction parameter $\gamma 2_{(m,\ B)}$ without modifying, the displacement at the border between the row of image E1 and the row of image E2 may not be moderated or reduced.

In view of this potential defect, in the present embodiment, the value modified from the correction parameter $\gamma 1_{(m)}$ in accordance with the nozzle shift amount B is taken as the correction parameter $\gamma 2_{(m,\ B)}$. With the modified value to the correction parameter $\gamma 2_{(m,\ B)}$ for the second scan-printing actions, as shown in FIG. 11C, displacement at the border between the row of image E1 and the row of image E2, which may be caused by the skew of the recording sheet P with regard to the conveying direction, may be moderated or reduced.

More Examples

Although an example of carrying out the invention has been described, those skilled in the art will appreciate that there are numerous variations and permutations of the printing apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters. Below will be described varied examples of the present embodiment.

For example, the correction parameters $\beta 2_{(m,\ B)}$, $\gamma 2_{(m,\ B)}$ may not necessarily be derived from the correction parameters $\beta 1_{(m)}$, $\gamma 1_{(m)}$ and the nozzle shift amount B for the first scan-printing action stored in the EEPROM 54, but the values to the correction parameters $\beta 2_{(m,\ B)}$, $\gamma 2_{(m,\ B)}$ may be derived in a method described below.

That is, the EEPROM 54 may store expansion-contraction information concerning expansive and contractive amounts of the recording sheet P in the scanning direction that may vary along the conveying direction, and the correction parameter $\beta 2_{(m,\ B)}$ may derived from the expansion-contraction information and the nozzle shift amount B. The expansion-contraction information may include, for example, information concerning the displacement amount R1 at the border between the rows of images E1. The expansion-contraction information may be obtained by, for example, a manufacturer manipulating the printer unit 2 to print a predetermined pattern of image on the recording sheet P and manipulating the reader unit 5 to read the image of the printed predetermined pattern from the recording sheet P, prior to shipping. In this setting with the expansion-contraction information, analogously to the embodiment described above, the larger the nozzle shift amount B is, the smaller the absolute value $|\beta 2_{(m,\ B)}|$ in the correction parameter $\beta 2_{(m,\ B)}$ is modified to be, and the modified value is determined to be the value to the correction parameter $\beta 2_{(m,B)}$. Thus, the displacement at the border between the image E1 and the image E2 may be moderated or reduced.

For another example, the EEPROM 54 may store skew information concerning a degree of inclination of the recording sheet P with respect to the conveying direction, and the correction parameter $\beta 2_{(m,\ B)}$ may derived from the skew information and the nozzle shift amount B. The skew information may include, for example, information of the amount Q1 of the displacement at the border between the rows of images E1 and information concerning an angle of the recording sheet with respect to the conveying direction. The skew information may be obtained by, for example, a manufacturer manipulating the printer unit 2 to print a predetermined pattern of image on the recording sheet P and manipulating the reader unit 5 to read the image of the printed predetermined pattern from the recording sheet P, prior to shipping. In this setting with the skew information, analogously to the embodiment described above, the larger the nozzle shift amount B is, the smaller the absolute value $|\gamma 2_{(m,\ B)}|$ in the correction parameter $\gamma 2_{(m,\ B)}$ is modified to be, and the modified value is determined to be the value to the correction parameter $\gamma 2_{(m,B)}$. Thus, displacement at the border between the rows of image E1 and image E2 may be moderated or reduced.

For another example, the recording sheet P may not necessarily be conveyed in the skip-conveying action in S303 or S304 for the length L3 or L4 separately from the first or second conveying actions in S201, S401 in the first or second unit-printing process. For example, an amount to convey the recording sheet P, which is either L3 or L4, derived from the comparison between the value A2 calculated in S301 and the threshold value Am, may be stored in the RAM 53. Thereafter, prior to a scan-printing action in a next unit-printing process, the recording sheet P may be conveyed for an amount, which combines the conveyance amount for the conveying action in S201 or S204, i.e., the conveyance amount either L1 or [L1−B], with the conveyance amount L3 or L4 stored in the RAM 53.

For another example, the skip-conveying action in S109 may not necessarily be conducted, regardless of the presence or absence of the blank area D in the print data, but may be omitted even when the blank area D is contained in the print data.

For another example, the threshold value Am may not necessarily be the value that corresponds to the position of the recording sheet P when the upstream end Pb of the recording sheet P with regard to the conveying direction is located at the upstream position spaced apart from the downstream ends 14*b* of the pressers 14*a* for the predetermined length L2. For example, the threshold value Am may be a value that corresponds to a position of the recording sheet P when the upstream end Pb of the recording sheet P with regard to the conveying direction is located at the same position as the downstream ends 14*b* of the pressers 14*a*. In this setting, the controller 50 may determine that the recording sheet P is at a position where the recording sheet P is not contacted or pressed by the pressers 14*a* when the upstream end Pb of the recording sheet P is at a position downstream with regard to the conveying direction from the downstream ends 14*b* of the pressers 14*a*.

For another example, the determination, whether the recording sheet P is to be conveyed to the position where the recording sheet P is not contacted or pressed by the pressers 14*a* as a result of conveyance in the first conveying action in the final unit-printing process, may not necessarily be made based on the comparison between the value A1 calculated in 5102 and the threshold value Am. For example, a sensor to detect the recording sheet P may be disposed at a position upstream for the length L1 of the nozzle arrays 9 from the position upstream from the downstream end 14*b* of the presser 14*a* for the length L2 so that the determination may be made depending on the output of the sensor.

For another example, the nozzle shift amount B may not necessarily be equal to the difference [A1−Am] between the value A1 calculated in S102 and the threshold value Am. For example, when the skip-conveying action is not conducted, the position of the recording sheet P immediately before the final unit-printing process may be anticipated by a size of the recording sheet P. Therefore, the nozzle shift amount B for each sheet size may be stored in advance in the EEPROM 54, and the nozzle shift amount for the sheet size of the current recording sheet P may be obtained from the EEPROM 54.

For another example, the second unit-printing process may not necessarily be conducted as the final unit-printing process alone but may be conducted as a non-final unit-printing process. For example, if all of the unit-printing processes are conducted by the first unit-printing processes, there may be a case that the recording sheet P would be conveyed to the position where the recording sheet is separated from the pressers 14*a* as a result of conveyance in the final one of the first unit-printing processes. In such a case, any one of the unit-printing processes may be conducted by the second unit-printing process. Even in this setting, the values to the correction parameters $\beta 2_{(m,\ B)}$, $\gamma 2_{(m,\ B)}$ may be provided analogously to the embodiment described above, and the displacement at the border between the rows of image E1 and image E2 may be moderated or reduced.

For another example, the second unit-printing process may not necessarily be conducted once among the plurality of unit-printing processes that may be repeated within a single printing operation to print an image on the recording sheet P but may be conducted for twice or more in the single printing operation. If the second unit-printing process is conducted for twice or more, e.g., for N times (N≥2), in a single printing operation, a nozzle shift amount for each of the second unit-printing processes may be set to be [B/N], or a sum of the nozzle shift amounts within the second scan-printing actions for the N times may be set to be equal to the nozzle shift amount B mentioned above.

For another example, the recording sheet P may not necessarily be shaped into the corrugated form that ripples up and down along the scanning direction but may be conveyed plainly flat along the scanning direction. Even in this setting, the recording sheet P being printed in the printer unit 2 may swell by the moisture of the ink landed thereon at the downstream part with regard to the inkjet head 12 while the upstream part with regard to the inkjet head 12 may be dry without the moisture. Therefore, the extent of the contraction or expansion of the recording sheet P along the scanning direction may vary depending on the position of the recording sheet P with regard to the conveying direction. Further, the recording sheet P may skew with respect to the conveying direction as well. Therefore, even in such a printer, in which the recording sheet P is conveyed flat, with the values to the correction parameters $\beta 2_{(m,\ B)}$, $\gamma 2_{(m,\ B)}$, the displacement at the border between the rows of image E1 and image E2 may be moderated or reduced.

In this setting of the printer, further, the pressers 14 to restrict the recording sheet P from hovering may not be arranged at the upstream position with respect to the nozzles 10*c* at the most upstream position among the plurality of nozzles 10 that form the nozzle arrays 9, or the pressers 14 to restrict the recording sheet P from hovering may even be omitted.

If the pressers to contact or press the recording sheet P from above are not omitted but are provided, analogously to the embodiment described above, the nozzle shift amount B, i.e., the conveyance amount [L1−B], may be considered so that the recording sheet P may not be conveyed to the position where the recording sheet P is not contacted or pressed by the pressers.

On the other hand, if the pressers to contact or press the recording sheet P from above are omitted, and if a length of the row of image to be printed in the final scan-printing action is shorter in the conveying direction than a length of the rows of images having been printed in the preceding scan-printing actions, the second unit-printing process may be conducted as the final unit-printing process. In this setting, analogously to the embodiment described above, with the values to the correction parameters $\beta 2_{(m,\ B)}$, $\gamma 2_{(m,\ B)}$, the displacement at the border between the rows of image E1 and image E2 may be moderated or reduced.

For another example, the nozzles 10*a* at the most downstream position with regard to the conveying direction among the entire nozzles 10 that form the nozzle arrays 9 may not necessarily be designated as the nozzles 10 active at a most downstream position for the first scan-printing action. Nozzles 10 that are in a position upstream from the nozzles 10*a* and downstream from the nozzles 10*c* among the nozzles 10 that form the nozzle arrays 9 may be designated as the nozzles 10 active at the most downstream position for the first scan-printing action. In other words, any of the nozzles 10 except the nozzles 10*c* at the most upstream position may be designated as the nozzles 10 active at the most downstream position for the first scan-printing action. In this regard, the nozzles 10 that are in a position upstream apart from the nozzles 10 active at the most downstream position for the first scan-printing action for the nozzle shift amount B in the conveying direction may be designated to be the nozzles 10 active at the most downstream position for the second scan-printing action.

For another example, absolute values in the values to the correction parameters $\beta 1_{(m)}$, $\gamma 1_{(m)}$, $\beta 1_{(m,\ B)}$, $\gamma 1_{(m,\ B)}$, may not necessarily be increased to be larger in order to provide a longer period of time to advance or delay the ejection timing. In other words, the correction parameters $\beta 1_{(m)}$, $\gamma 1_{(m)}$, $\beta 2_{(m,\ B)}$, $\gamma 2_{(m,\ B)}$, may be diminished to be smaller in order to provide a longer period of time to advance or delay the ejection timing.

For another example, the reference position to determine the upstream side and the downstream side of the moving direction of the carriage 11 on the recording sheet P, so that determination whether the ejection timing should be advanced or delayed may be made depending on the position on the recording sheet P with regard to the moving direction, to correct the ejection timing with the correction parameters $\beta 1_{(m)}$, $\gamma 1_{(m)}$, $\beta 2_{(m,\ B)}$, $\gamma 2_{(m,\ B)}$, may not necessarily be set at the center 60*a*, but the reference position may be set at a position displaced from the center 60*a* in the scanning direction.

For another example, the ink may not necessarily be ejected at positions displaced leftward or rightward in the scanning direction depending on the position of row of the scan-printing action on the recording sheet P in the conveying direction with respect to the center Pc2. The ink may be ejected at positions displaced leftward or rightward depending on the position of the row of the scan-printing action on the recording sheet P in the conveying direction with respect to a different position than the center Pc2.

For another example, the embodiment described above may not necessarily be applied to an image printing operation, in which a row of image is printed in a single scan-printing action. The embodiment may be applied to so-called interlace printing, in which an amount to convey the recording sheet P in a single conveying action may be reduced to be, for example, a half of an amount for the row, and the scan-printing action may be repeated on the same row to form the row of image.

For another example, the embodiment described above may not necessarily be applied to a printer that corrects the ejection timing for the scan-printing actions in consideration of the displacement of the ink landing positions due to the expansion or contraction of the recording sheet P in the scanning direction and the displacement of the ink landing positions due to the skew of the recording sheet P being conveyed with respect to the conveying direction. The embodiment in the present disclosure may be applied to a printer that may correct the ejection timing for the scan-printing actions in consideration of the displacement of the ink landing positions due to one of the causes, i.e., expansion/contraction and skew, mentioned above.

For another example, the embodiment described above may not necessarily be applied to an inkjet printer, in which the ink is ejected through the nozzles to print an image on the recording sheet P, but may be analogously applied to a liquid ejection device, for example, that may discharge liquid to print a wiring pattern on a circuit board.

What is claimed is:

1. A printing apparatus, comprising:

a conveyor configured to convey a recording sheet in a conveying direction;

a liquid ejection head comprising a plurality of nozzles, the plurality of nozzles being arranged along the conveying direction to form a nozzle array;

a carriage, on which the liquid ejection head is mounted;

a carriage movement mechanism configured to move the carriage in a carriage-movable direction, the carriage-movable direction including a direction from one side toward the other side and a direction from the other side toward the one side along a direction that intersects with the conveying direction; and a controller configured to control the conveyor, the liquid ejection head, and the carriage movement mechanism, wherein the controller executes a printing operation, in which a plurality of unit-printing processes are executed, each one of the plurality of unit-printing processes comprising a conveying action, in which the controller controls the conveyor to convey a recording sheet in the conveying direction, and a scan-printing action, in which after the conveying action the controller controls the carriage movement mechanism and the liquid ejection head to move the carriage in the carriage-movable direction and manipulate the plurality of nozzles to eject liquid at the recording sheet;

wherein the conveying action comprises:

a first conveying action, in which a first nozzle, among the plurality of nozzles that form the nozzle array, located at a position downstream from a most upstream one of the plurality of nozzles with regard to the conveying direction is designated to be a nozzle active at a most downstream position with regard to the conveying direction for the scan-printing action, and in which the controller controls the conveyor to convey the recording sheet for a first conveyance amount based on print data; and a second conveying action, in which a second nozzle, among the plurality of nozzles that form the nozzle array, located at a position upstream with regard to the conveying direction apart from the first nozzle for a length corresponding to a sum of hitherto conveyance amounts for the recording sheet conveyed in preceding conveying actions in the plurality of unit-printing processes in the printing operation is designated to be a nozzle active to print a most downstream part of an image that is to be printed in the scan-printing action, and in which the controller controls the conveyor to convey the recording sheet for a second conveyance amount, which is smaller than the first conveyance amount for a nozzle shift amount, the nozzle shift amount being equal to a length between the first nozzle and the second nozzle along the conveying direction;

wherein the controller executes one of a first unit-printing process and a second unit-printing process for each one of the plurality of unit-printing processes in the printing operation, the first unit-printing process taking the first conveying action as the conveying action, and the second unit-printing process taking the second conveying action as the conveying action;

wherein in the printing operation the controller executes:

a parameter determining process, in which a value to a correction parameter is determined, the correction parameter being a parameter to correct ejection timing to eject the liquid through the plurality of nozzles in the scan-printing action; and an ejection timing determining process, in which the ejection timing is determined based on the value to the correction parameter;

wherein, in the ejection timing determining process, the controller determines the ejection timing based on a reference timing by shifting the ejection timing to be at least one of later and earlier than the reference timing for a time length corresponding to the value to the correction parameter; and wherein, in the parameter determining process, the controller provides a different value to the correction parameter for the scan-printing action in the second unit-printing process depending on the nozzle shift amount.

2. The printing apparatus according to claim 1, wherein, in the ejection timing determining process, the controller determines the ejection timing based on the reference timing by one of:

delaying and advancing, in which, for an upstream area located on an upstream side of a reference position in the recording sheet with regard to the carriage-movable direction, the ejection timing is delayed from the reference timing to be later than the ejection timing for the time length corresponding to the value to the correction parameter, and for a downstream area located on a downstream side of the reference position in the recording sheet with regard to the carriage-movable direction, the ejection timing is advanced from the reference timing to be earlier than the ejection timing for the time length corresponding to the value to the correction parameter; and advancing and delaying, in which, for the upstream area, the ejection timing is advanced from the reference timing to be earlier than the ejection timing for the time length corresponding to the value to the correction parameter, and for the downstream area, the ejection timing is delayed from the reference timing to be later than the ejection timing for the time length corresponding to the value to the correction parameter.

3. The printing apparatus according to claim 1, wherein, in the ejection timing determining process, the controller determines the ejection timing based on the reference timing by one of delaying the ejection timing to be later and advancing the ejection timing to be earlier than the reference timing for the time length corresponding to the value to the correction parameter regardless of a position in the carriage-movable direction, at which the liquid is ejected, on the recording sheet.

4. The printing apparatus according to claim 3, further comprising an expansion-contraction information storage configured to store information concerning variations of expansive and contractive amounts of the recording sheet in the carriage-movable direction, the expansive and contractive amounts being variable along the conveying direction, wherein, in the parameter determining process, the controller determines the value to the correction parameter for the scan-printing action in the second unit-printing process based on the nozzle shift amount and the expansion-contraction information.

5. The printing apparatus according to claim 4, wherein, in the ejection timing determining process, the controller determines the ejection timing such that the larger value the correction parameter indicates, for the longer period of time the ejection timing is shifted from the reference timing; and wherein, in the parameter determining process, the controller determines the value to the correction parameter such that the larger the nozzle shift amount is, the smaller value the correction parameter for the scan-printing action in the second unit-printing process takes.

6. The printing apparatus according to claim 3, further comprising a skew information storage configured to store skew information concerning a degree of inclination of the recording sheet with respect to the conveying direction, wherein, in the parameter determining process, the controller determines the value to the correction parameter for the scan-printing action in the second unit-printing process based on the nozzle shift amount and the skew information.

7. The printing apparatus according to claim 6, wherein, in the ejection timing determining process, the controller determines the ejection timing such that the larger value the correction parameter indicates, for the longer period of time the ejection timing is shifted from the reference timing; and wherein, in the parameter determining process, the controller determines the value to the correction parameter such that the larger the nozzle shift amount is, the smaller value the correction parameter for the scan-printing action in the second unit-printing process takes.

8. The printing apparatus according to claim 1, further comprising:

a memory configured to store parameter information related to the value to the correction parameter for the scan-printing action executed in the first unit-printing process, wherein, in the parameter determining process, the controller determines:

a value corresponding to the parameter information stored in the memory to be the value to the correction parameter for the scan-printing action executed in the first unit-printing process; and a value modified from the value corresponding to the parameter information in accordance with the nozzle shift amount to be the value to the correction parameter for the scan-printing action executed in the second unit-printing process.

9. The printing apparatus according to claim 1, wherein the first nozzle is a nozzle at a most downstream position with regard to the conveying direction among the plurality of nozzles that form the nozzle array.

10. The printing apparatus according to claim 1, further comprising a contact part configured to contact the recording sheet at a position upstream with regard to the conveying direction from the most upstream one of the plurality of nozzles that form the nozzle array.

11. The printing apparatus according to claim 10, wherein the controller executes the first unit-printing process for each one of the plurality of unit-printing processes except for a final one of the plurality of unit-printing processes;

wherein the controller executes a conveyance predicting process, in which the controller determines whether the recording sheet is predicted to be conveyed to a position where the recording sheet is not contacted by the contact part as a result of conveyance in a next hypothetical first unit-printing process for the final one of the plurality of unit-printing processes;

wherein, if the controller determines in the conveyance predicting process that the recording sheet is predicted to be conveyed to the position where the recording sheet is not contacted by the contact part as the result of conveyance in the next hypothetical first unit-printing process for the final one of the plurality of unit-printing processes, the controller executes the second unit-printing process for the final one of the plurality of unit-printing processes; and wherein the controller designates the second nozzle such that an upstream end of the recording sheet with regard to the conveying direction is to be located at a position upstream apart from the downstream end of the contact part for a contact length as a result of the second conveying action in the second unit-printing process.

12. The printing apparatus according to claim 11, wherein, if the controller determines in the conveyance predicting process that the recording sheet is predicted to be conveyed to a position where the recording sheet is contacted by the contact part as a result of conveyance in the next hypothetical first unit-printing process for the final one of the plurality of unit-printing processes, the controller exceptionally executes the first unit-printing process for the final one of the plurality of unit-printing processes.

13. The printing apparatus according to claim 11, further comprising:

a memory configured to store threshold information concerning a threshold value that indicates a position of the recording sheet when the upstream end of the recording sheet with regard to the conveying direction is located at the position upstream apart from the downstream end of the contact part for the contact length, wherein the controller executes a calculating process, in which the controller calculates a value that indicates a predicted position of the recording sheet with regard to the conveying direction after being conveyed in a hypothetical first conveying action in the hypothetical first unit-printing process for the final one of the plurality of unit-printing processes;

wherein, in the conveyance predicting process, when the value calculated in the calculating process is larger than the threshold value, the controller determines that the recording sheet is predicted to be conveyed to the position where the recording sheet is not contacted by the contact part as the result of conveyance in the next hypothetical first unit-printing process for the final one of the plurality of unit-printing processes; and wherein, in the second unit-printing process, the controller designates the second nozzle based on a difference between the value calculated in the calculating process and the threshold value.

14. The printing apparatus according to claim 10, further comprising:

a container configured to contain a plurality of types of recording sheets in different sizes, wherein the controller controls the conveyor to convey one of the plurality of types of the recording sheets contained in the container selectively;

wherein the controller executes the first unit-printing process for each one of the plurality of unit-printing processes except for a final one of the plurality of unit-printing processes;

wherein the controller executes a conveyance predicting process, in which the controller determines based on a type of the recording sheet selectively conveyed among the plurality of types of the recording sheets whether the selectively conveyed recording sheet is predicted to be conveyed to a position where the selectively conveyed recording sheet is not contacted by the contact part as a result of conveyance in a next hypothetical first unit-printing process for the final one of the plurality of unit-printing processes;

wherein, if the controller determines in the conveyance predicting process that the selectively conveyed recording sheet is predicted to be conveyed to the position where the selectively conveyed recording sheet is not contacted by the contact part as the result of conveyance in the next hypothetical first unit-printing process for the final one of the plurality of unit-printing processes, the controller executes the second unit-printing process for the final one of the plurality of unit-printing processes; and wherein the controller designates the second nozzle based on the type of the selectively conveyed recording sheet.

15. The printing apparatus according to claim 1, wherein the controller executes the first unit-printing process for each one of the plurality of unit-printing processes except for a final one of the plurality of unit-printing processes; and wherein the controller executes the second unit-printing process for the final one of the plurality of unit-printing processes.

16. The printing apparatus according to claim 1, wherein, in the printing operation, the controller executes a blank determining process for each one of the plurality of unit-printing processes except for a final one of the plurality of unit-printing processes, in the blank determining process the controller determining based on the print data whether a blank area, in which no image is to be printed, having a length along the conveying direction larger than a minimum length, is contained in an area at an upstream adjacent position from an image printed in the scan-printing action in a preceding one of the plurality of unit-printing processes; and wherein, if the controller determines that the blank area is contained in the blank determining process, in the conveying action in a next one of the plurality of unit-printing processes following the preceding one of the plurality of unit-printing processes, the controller controls the conveyor to convey the recording sheet for a third conveyance amount corresponding to the length of the blank area along the conveying direction, the third conveyance amount being larger than a fourth conveyance amount, for which the recording sheet is conveyed if the blank area is not contained.

* * * * *